US012571280B1

(12) United States Patent
Pruitt et al.

(10) Patent No.: US 12,571,280 B1
(45) Date of Patent: Mar. 10, 2026

(54) SEALED LUBRICATING HEAD AND TOP DRIVE GUIDE

(71) Applicant: PRUITT TOOL & SUPPLY CO., Fort Smith, AR (US)

(72) Inventors: Grant Pruitt, Fort Smith, AR (US); Cris Braun, Van Buren, AR (US); Benjamin Micah Spahn, Alma, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 0 days.

(21) Appl. No.: 18/674,293

(22) Filed: May 24, 2024

Related U.S. Application Data

(63) Continuation of application No. 17/567,837, filed on Jan. 3, 2022, now Pat. No. 11,993,997, which is a continuation-in-part of application No. 16/544,612, filed on Aug. 19, 2019, now Pat. No. 11,215,025, which is a continuation of application No. 15/489,710, filed on Apr. 17, 2017, now Pat. No. 10,385,646, which is a continuation-in-part of application No. 14/214,826, filed on Mar. 15, 2014, now Pat. No. 9,624,749.

(60) Provisional application No. 61/801,175, filed on Mar. 15, 2013.

(51) Int. Cl.
*E21B 33/08* (2006.01)
*E21B 33/04* (2006.01)

(52) U.S. Cl.
CPC ..... *E21B 33/085* (2013.01); *E21B 33/04* (2013.01)

(58) Field of Classification Search
CPC ..... E21B 19/10; E21B 33/06; E21B 33/08; E21B 33/085
See application file for complete search history.

(56) References Cited

U.S. PATENT DOCUMENTS 2,176,355 A * 10/1939 Otis ..... E21B 33/085 277/503
2,233,041 A * 2/1941 Alley ..... E21B 33/06 166/212
2,303,090 A * 11/1942 Pranger ..... E21B 33/085 277/516
3,285,352 A * 11/1966 Hunter ..... E21B 33/085 175/214
3,400,938 A * 9/1968 Williams ..... E21B 21/16 277/346
3,724,862 A * 4/1973 Biffle ..... F16J 15/185 277/510
4,208,056 A * 6/1980 Biffle ..... F16J 15/54 251/1.2

(Continued)

FOREIGN PATENT DOCUMENTS

CN 101796259 A * 8/2010 ..... E21B 33/085
GB 2362668 A * 11/2001 ..... E21B 33/085

*Primary Examiner* — Jennifer H Gay
(74) *Attorney, Agent, or Firm* — Schrantz Law Firm, PLLC; Stephen D. Schrantz

(57) ABSTRACT

The sealed lubricating head provides a lubricating compartment with no oiler or oil lines. The lubricating compartment is sealed by a top seal and a bottom seal that seals between the inner barrel and the outer barrel. The sealed lubricating head provides a bottom seal that seals the lubricating compartment. A rubber adapter secures the seal while also securing the rubber to the inner barrel.

11 Claims, 33 Drawing Sheets

(56) References Cited

U.S. PATENT DOCUMENTS 4,285,406 A * 8/1981 Garrett ..... E21B 3/04 277/343
4,304,310 A * 12/1981 Garrett ..... E21B 33/085 285/16
4,312,404 A * 1/1982 Morrow ..... E21B 33/085 166/88.4
4,363,357 A * 12/1982 Hunter ..... E21B 33/085 285/55
4,383,577 A * 5/1983 Pruitt ..... E21B 33/085 175/195
4,406,333 A * 9/1983 Adams ..... E21B 33/085 277/343
4,480,703 A * 11/1984 Garrett ..... E21B 3/04 277/343
4,529,210 A * 7/1985 Biffle ..... E21B 33/085 251/1.2
4,531,591 A * 7/1985 Johnston ..... E21B 33/085 175/57
4,745,970 A * 5/1988 Bearden ..... E21B 33/085 166/84.3
4,783,084 A * 11/1988 Biffle ..... E21B 33/085 166/85.4
4,949,796 A * 8/1990 Williams ..... E21B 33/085 175/209
5,647,444 A * 7/1997 Williams ..... E21B 33/085 166/84.1
5,662,181 A * 9/1997 Williams ..... E21B 33/085 166/84.3
5,791,411 A * 8/1998 Ricalton ..... E21B 33/085 166/84.1
6,520,253 B2 * 2/2003 Calder ..... E21B 33/085 166/84.2
6,725,951 B2 * 4/2004 Looper ..... E21B 33/085 166/89.1
7,726,416 B2 * 6/2010 Williams ..... E21B 33/085 175/195
7,798,210 B1 * 9/2010 Pruitt ..... E21B 33/085 277/343
7,870,896 B1 * 1/2011 Pruitt ..... E21B 33/085 277/343
8,573,293 B1 * 11/2013 Pruitt ..... E21B 33/085 277/343
8,905,150 B1 * 12/2014 Pruitt ..... E21B 33/085 166/387
8,991,484 B2 * 3/2015 Riggs ..... F16L 27/0804 166/84.1
9,121,249 B1 * 9/2015 Pruitt ..... E21B 33/04
9,243,730 B1 * 1/2016 Pruitt ..... E21B 33/085
9,267,350 B1 * 2/2016 Pruitt ..... E21B 33/085
9,624,749 B1 * 4/2017 Pruitt ..... E21B 33/085
9,856,713 B2 * 1/2018 Tarique ..... E21B 33/085
10,041,324 B1 * 8/2018 Pruitt ..... E21B 33/085
10,138,700 B1 * 11/2018 Pruitt ..... E21B 33/085
10,385,646 B1 * 8/2019 Pruitt ..... E21B 33/085
10,801,296 B1 * 10/2020 Pruitt ..... E21B 33/08
10,876,372 B1 * 12/2020 Pruitt ..... E21B 33/085
11,008,825 B2 * 5/2021 Fraczek ..... E21B 33/085
11,193,338 B2 * 12/2021 Chambers ..... E21B 33/085
11,215,025 B1 * 1/2022 Pruitt ..... E21B 33/085
11,808,111 B2 * 11/2023 Chambers ..... E21B 36/001
11,993,997 B1 * 5/2024 Pruitt ..... E21B 33/04
2001/0047885 A1 * 12/2001 Calder ..... E21B 33/0387 166/84.2
2003/0056992 A1 * 3/2003 Looper ..... E21B 33/085 166/84.3
2005/0236835 A1 * 10/2005 Williams ..... F16B 21/04 285/361
2006/0032635 A1 * 2/2006 Rivard ..... E21B 43/126 166/287
2006/0144622 A1 * 7/2006 Bailey ..... E21B 47/10 175/230
2009/0057020 A1 * 3/2009 Williams ..... E21B 33/085 175/195
2009/0057027 A1 * 3/2009 Williams ..... E21B 33/085 175/195
2011/0036629 A1 * 2/2011 Bailey ..... F16J 15/324 175/48
2012/0085545 A1 * 4/2012 Tarique ..... E21B 33/085 166/360
2013/0020068 A1 * 1/2013 Boyd ..... E21B 33/085 166/84.1
2013/0032359 A1 * 2/2013 Riggs ..... F16L 23/10 166/84.1
2015/0013994 A1 * 1/2015 Bailey ..... E21B 21/01 166/384
2015/0376972 A1 * 12/2015 Lock ..... E21B 19/00 166/381
2017/0051785 A1 * 2/2017 Cooper ..... F16C 33/7886
2017/0167221 A1 * 6/2017 Reinhardt ..... E21B 3/00
2018/0058169 A1 * 3/2018 Le ..... E21B 17/01
2019/0112890 A1 * 4/2019 Richie ..... F16J 15/324
2020/0340326 A1 * 10/2020 Leuchtenberg ..... E21B 33/085

* cited by examiner

SEALED LUBRICATING HEAD AND TOP DRIVE GUIDE

CROSS-REFERENCE TO RELATED APPLICATIONS

This application claims priority to and is a continuation of U.S. patent application Ser. No. 17/567,837 SEALED LUBRICATING HEAD AND TOP DRIVE GUIDE filed on Jan. 3, 2022 which is a continuation in part of U.S. patent application Ser. No. 16/544,612 entitled SEALED GREASE HEAD AND TOP DRIVE GUIDE filed on Aug. 19, 2019 that issued as U.S. Pat. No. 11,215,025 on Jan. 4, 2022 which is a continuation of U.S. patent application Ser. No. 15/489,710 entitled SEALED GREASE HEAD AND TOP DRIVE GUIDE filed on Apr. 17, 2017 that issued as U.S. Pat. No. 10,385,646 on Aug. 20, 2019 which is a continuation in part of U.S. patent application Ser. No. 14/214,826 entitled CASING STRIPPER DEVICE filed on Mar. 15, 2014 that issued as U.S. Pat. No. 9,624,749 on Apr. 18, 2017 which is a continuation in part of U.S. Patent Application No. 61/801,175 filed on Mar. 15, 2013 entitled Sealed Grease Head and Top Drive Guide.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

Field of the Invention

A rotating control device (RCD) in a drilling operation contains fluids and manages pressure for the drilling operation. In certain situations, the drilling rig provides limited space for the drilling operation. In most of these instances, the overhead space above the RCD is limited by the rig providing the rig personnel with limited space to operate.

In known embodiments, a kelly drive attaches to the top of the RCD. The kelly drive rotates the inner barrel of the RCD with the drill string. The attachment of the kelly drive above the inner barrel increases the height of the RCD. The increased height of the kelly drive attached to the RCD limits the space above the RCD which is needed by rig personnel. Removal of the kelly drive assists the rig personnel with the operation of the rig by providing additional operating room for the rig personnel.

The removal of the kelly drive reduces the height of the RCD by at least three inches, approximately four inches. However, removal of the kelly drive exposes the inner barrel to potential damage. The top drive guide of the present invention creates a lower profile RCD by decreasing the overall height of the RCD by approximately four inches by removing the kelly drive unit. The top drive guide also protects the inner barrel while stabbing the inner barrel and rubber with the mandrel. Furthermore, the top drive guide is installed and removed rather easily. It also eliminates the need to weld a hard face on the driver surface.

The present invention also provides a sealed lubricating head with a separate lubricating compartment. Lubricant, including, but not limited to, oil or grease, installed in the lubricating compartment lubricates the bearings and the seals to assist with operation of the RCD. The improved lubricating compartment provides sufficient lubricant to an upper bearing and a lower bearing. The lubricating compartment stores sufficient lubricant to be applied to the upper bearing and the lower bearing.

The present invention also provides an improved stripper rubber that reduces the costs and manufacture of stripper rubbers. The present invention provides a housing for a stripper rubber that includes a top retainer, a base plate, and at least one rubber disc. The disc is secured between the retainer and base plate. The number of rubber discs secured between the retainer and base plate will depend on the operation and pressure of the drilling operation.

SUMMARY OF THE INVENTION

In the known art, a kelly driver attaches above the RCD for rotation of the inner barrel with the drill string. However, the attachment of the kelly drive increases the height of the RCD. The top guide drive of the present invention eliminates the need for the kelly drive, thus creating additional work space above the RCD.

The top drive guide assists with insertion of the drill string through the inner barrel and a rubber found in the RCD. The top drive guide aligns the drill string with the inner barrel and rubber for insertion through the inner barrel and the rubber. The top drive guide positions the drill string within the rubber for rotation of the inner barrel with the drill string. The contact of the drill string with the rubber caused by the top drive guide rotates the inner barrel with the drill string. The top drive guide may be used either in a low pressure head or a high pressure head.

The present invention also provides a sealed lubricating head that provides a lubricating compartment. The lubricating compartment is sealed by a top seal and a bottom seal. The lubricating compartment supplies lubricant to the bearings between the inner barrel and outer barrel of the RCD. The lubricant flows to the bearings and seals to assist with the rotation of the inner barrel.

The present invention also provides a new casing stripper rubber that replaces stripper rubbers. The stripper rubber of the present invention decreases the costs of manufacturing the known stripper rubbers. The casing stripper rubber of the present invention utilizes rubber discs installed between a retainer and base plate. The retainer, rubber discs, and base plate are then installed into a nipple. Retention fingers on the nipple prevent the retainer, rubber discs, and base plate from passing through the nipple and into the hole.

It is an object of the present invention to provide rig personnel with additional room for operating the rig.

It is a further object of the present invention to decrease the overall height of the RCD.

It is a further object of the present invention to protect the inner barrel.

It is a further object of the present invention to eliminate the need for a kelly driver.

It is a further object of the present invention to use the sealing element of the RCD to grip the drill string to rotate the RCD.

It is a further object of the present invention to provide an improved lubricating compartment for lubricating the bearings and the seals of the RCD.

It is a further object of the present invention to eliminate and/or reduce lubricant from expanding through the seals and out of the compartments.

Another object of the present invention is to allow larger drilling tools, down hole tools, and casing to pass through the attachment body and casing stripper.

Another object of the present invention is to maintain lubricant within the lubricating compartment.

Another object of the present invention is to create a safer work environment for rig personnel.

Another object of the present invention is to provide a larger bore size that enables rig operators to run larger size bits in the hole. Frequently large drill bits are pulled up into the RCD while stripping out of the well that become stuck in the RCD bore. These stuck drill bits increase down time on the rig increasing the drilling costs to the driller. These stuck drill bits also create higher refurbishing costs to the manufacturer to remove the stuck bit from the equipment.

Another object of the present invention is to lower drilling costs.

Another object of the present invention is to reduce downtime of the drilling operation.

It is another object of the present invention to reduce the costs of stripper rubbers. It is another object of the present invention to provide one or two sealing elements, such as rubbers, with a simple bolt on conversion.

It is another object of the present invention to provide a low maintenance design.

It is another object of the present invention to eliminate the need for oil lines, oiler and power needed for pumping oil into the RCD during operation.

It is another object of the present invention to provide a bolt on sealing elements, such as the rubbers.

It is another object of the present invention to simplify maintenance.

It is another object of the present invention to reduce refurbishment time.

It is another object of the present invention to provide a more compact design.

It is another object of the present invention to provide an integrated seal surface on the inner barrel.

It is another object of the present invention to increase the bore size to 9 1/16" thru bore that is 13/16" larger than other low pressure designs.

It is another object of the present invention to implement a bottom debris cover to seal off the bottom of the RCD from well bore debris.

It is another object of the present invention to provide a Teflon® seal, such as PTFE (polytetrafluoroethylene) seal, that reduces friction and heat buildup.

It is another object of the present invention to provide NACE MR175/ISO 15156-1 compliant materials.

In addition to the features and advantages of the sealed lubricating head and the top drive guide according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

In well drilling, with a rotary drilling rig, the drill bit and drilling pipe receive rotary motion from power equipment located on the surface. Below the drilling floor, at the ground surface, there is usually an assembly known as a rotating head that circulates various fluids used in the drilling. The present invention relates to rotating heads for oil and gas wells and more particularly, to an improved rotating head that enables the ease of use for the end user.

Figure 1:
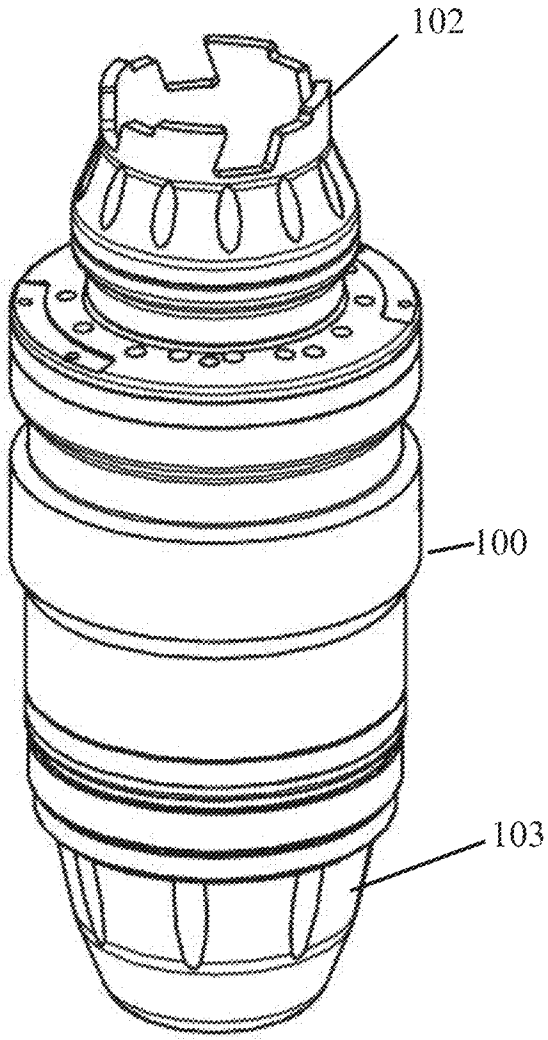
FIG. 1 is an environmental view of one embodiment of the present invention.

FIG. 1 shows an RCD 100 with a kelly driver 102 attached at the top of the RCD 100. In the known art, the kelly driver receives the rotary motion from the power equipment described above. The kelly driver increases the height of the RCD to receive this rotary motion from the power equipment.

Figure 2:
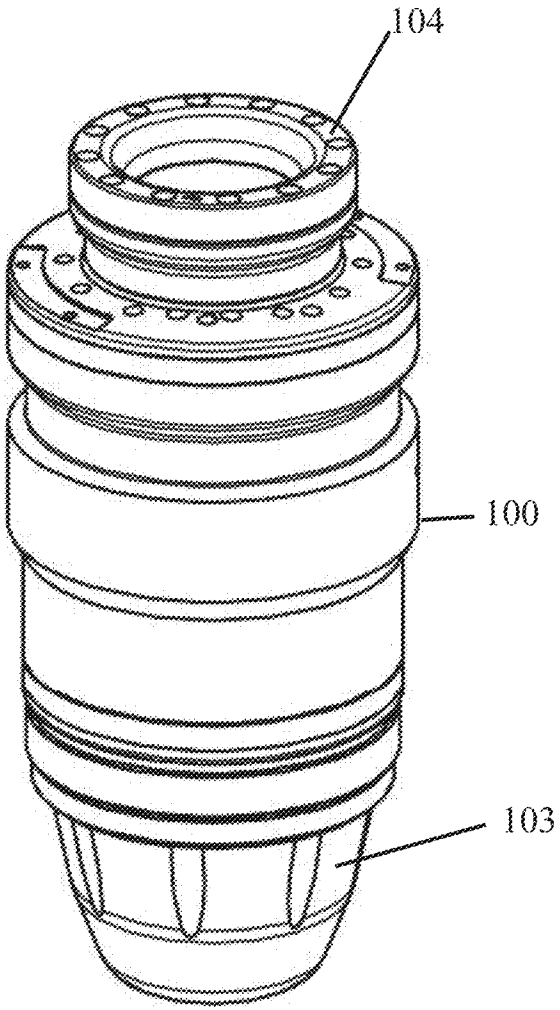
FIG. 2 is an environmental view of one embodiment of the present invention.

FIG. 2 shows an RCD 100 with a top drive guide 104 attached at the top of the RCD 100. FIGS. 1 and 2 show a side by side comparison of the increased height of the RCD 100 created by the kelly drive 102. The top drive guide 104 reduces the overall height of the RCD thus creating additional overhead space for the rig personnel.

FIGS. 1 and 2 show rubber 103 that is located on the RCD 100. The rubber 103 seals the drilling string. A drilling string is inserted or "stabbed" through the rotating head assembly, including the one or two rubbers 103 rotatably mounted in the rotating head assembly, to seal the drilling string.

Figure 3:
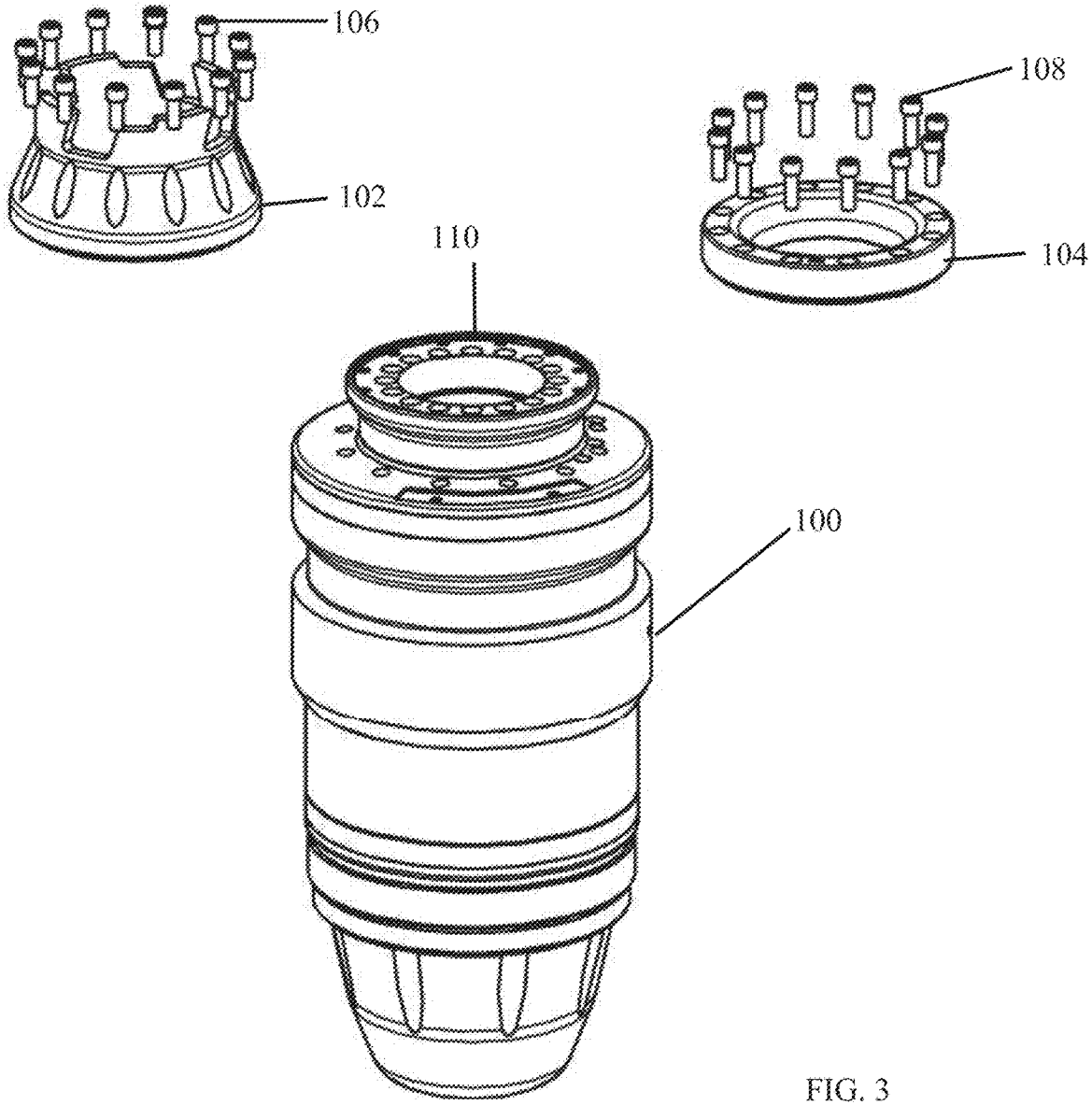
FIG. 3 is an environmental view of one embodiment of the present invention

FIG. 3 shows the attachment of the kelly drive 102 or the top drive guide 104 to the inner barrel 110 of the RCD 100. In one embodiment, the kelly drive 102 or the top drive guide 104 are attached to the inner barrel 110 by fasteners 106, 108. In one embodiment, the top drive guide 104 is bolted to the inner barrel 110 by bolts. Other known fasteners may attach the top drive guide 104 to the inner barrel 110.

FIG. 2 shows the top drive guide 102 attached to the top of the inner barrel 110. The top drive guide 102 protects the inner barrel 110 while stabbing the mandrel through the inner barrel 110. The attachment of the top drive guide 102 by fasteners 108 enables the users to quickly and easily attach and remove the top drive guide 102.

Figure 4:
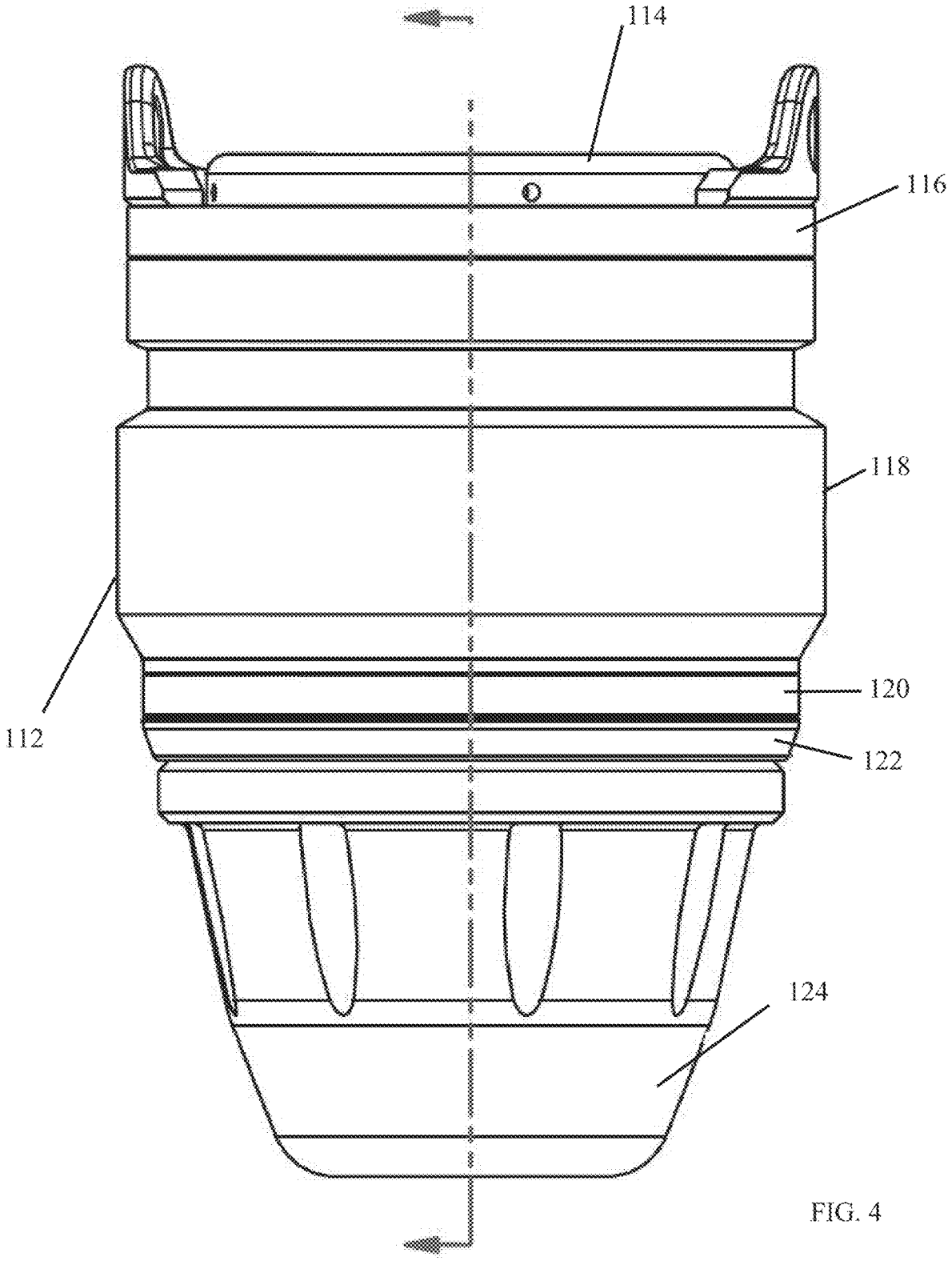
FIG. 4 is an environmental view of one embodiment of the present invention.

FIG. 4 shows the sealed lubricating head 112 of the present invention and another embodiment of the top drive guide 114. Referring to FIGS. 4-8, the top drive guide 114 installs to the inner barrel through fasteners attached at fastener apertures 134. In one embodiment, the fastener apertures 134 may be set screw holes. Four fastener apertures 134 located along the side wall of the top drive guide 114 enable attachment of the top drive guide 114 to the inner barrel. The larger bore 130 of the top drive guide allows larger drill bits to be used down hole. Lip 136 found within bore 130 provides additional clearance between the inner barrel and the outer barrel 118.

The top drive guide 114 also provides an O-ring groove 132 for installing an O-ring to seal the head. The O-ring seals the head to limit debris from entering the head.

Figure 5:
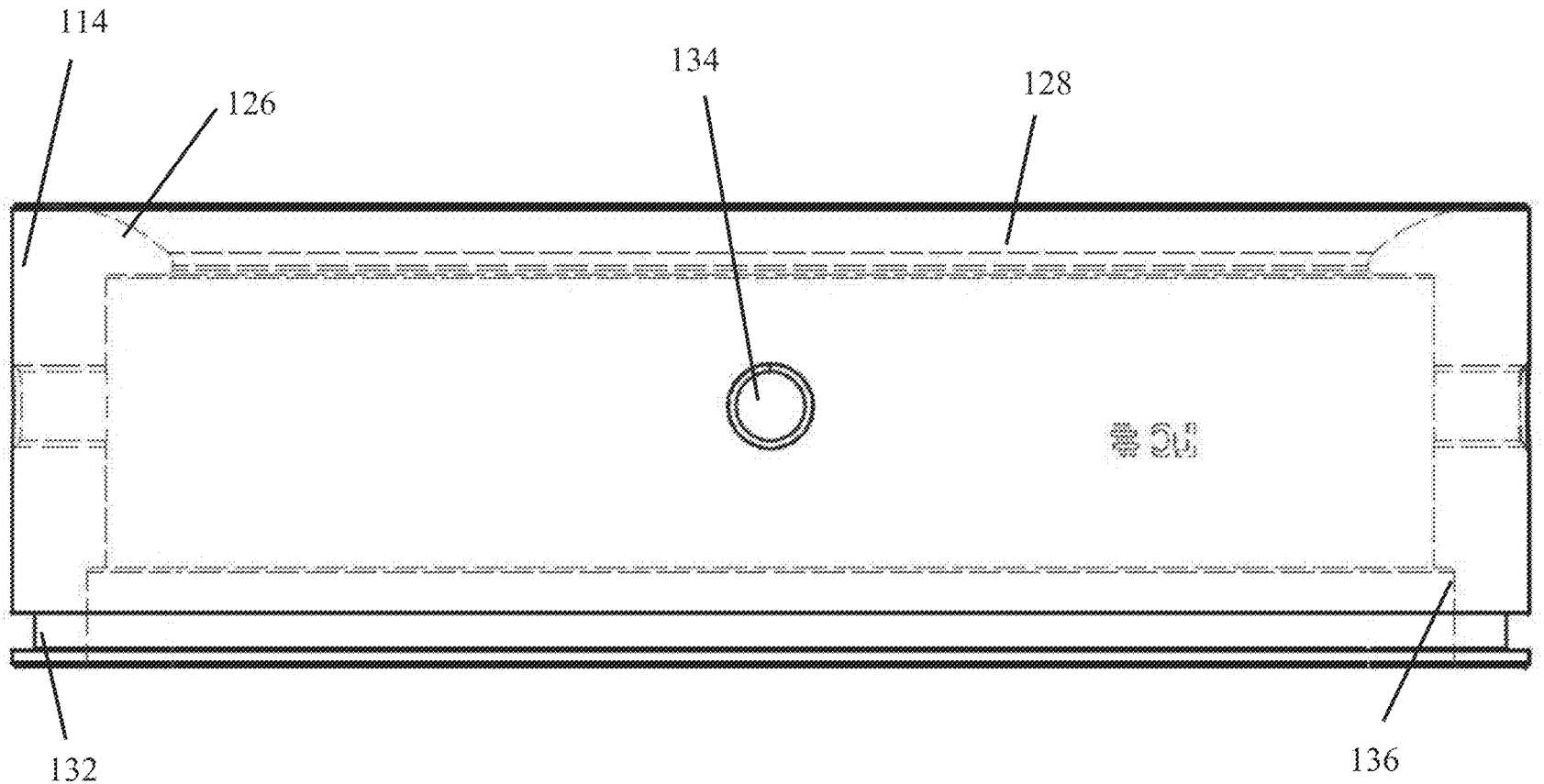
FIG. 5 is a sectional view of a top drive guide of one embodiment of the present invention.
Figure 6:
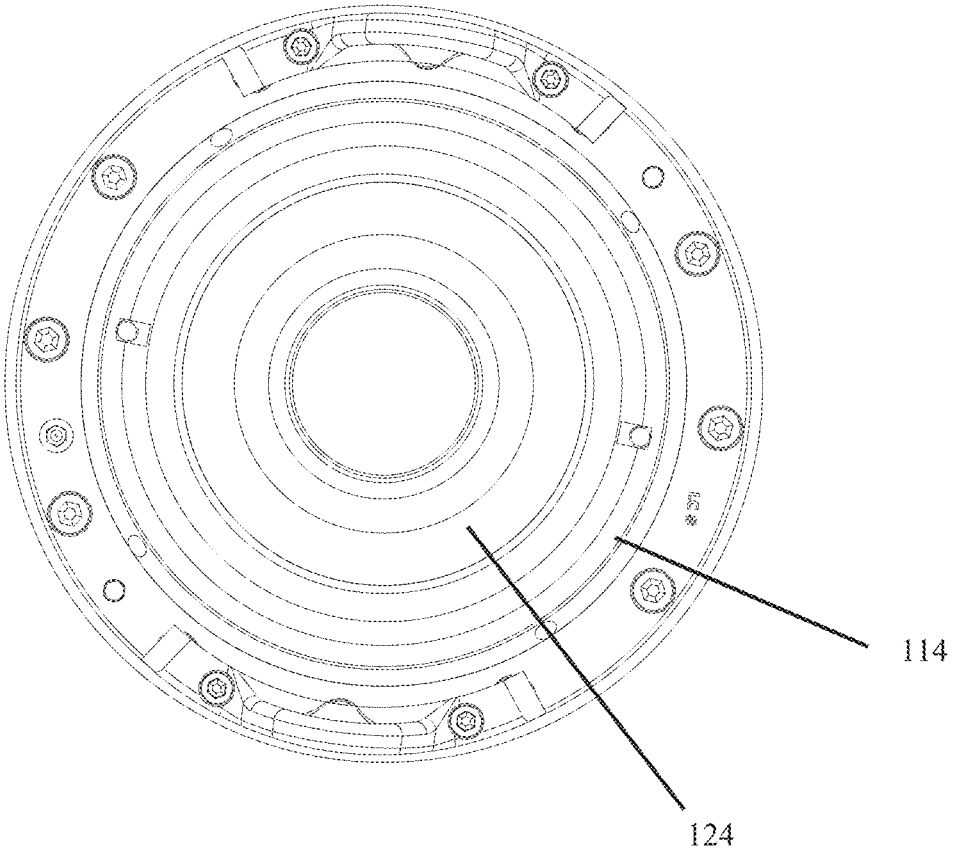
FIG. 6 is a top environmental view thereof.
Figure 7:
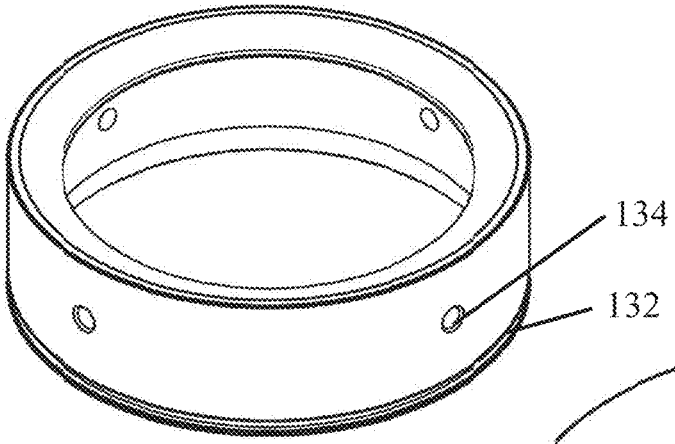
FIG. 7 is a top perspective view of a top drive guide of one embodiment of the present invention.
Figure 8:
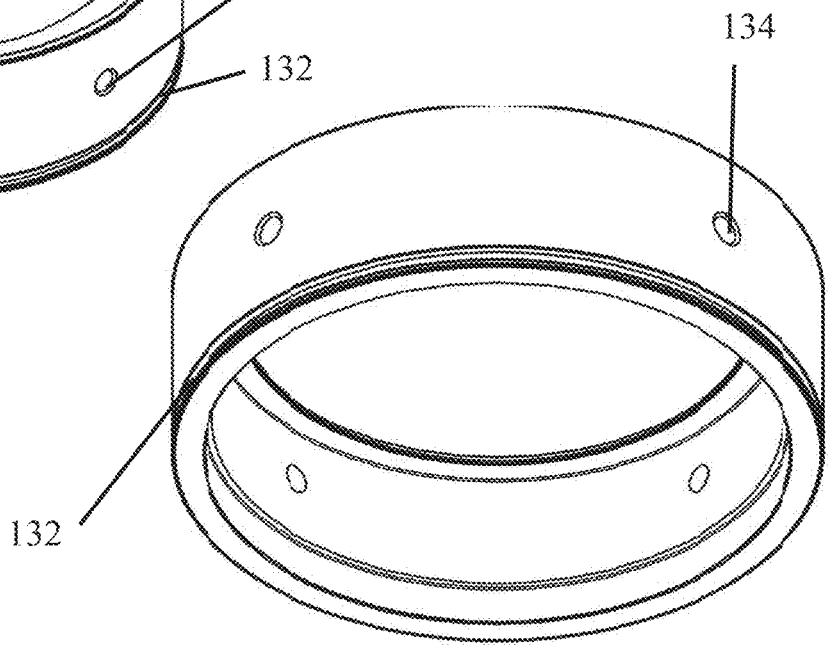
FIG. 8 is a bottom perspective view thereof.

Guide finger 126 located along the upper interior of the top drive guide 114 shown in FIG. 5 will now be described in more detail. Referring to FIG. 5, the guide finger 126 directs the mandrel towards bore 130. The guide finger 126 angles inward down towards the bore 130. As the mandrel is inserted into the aperture 128 of the top drive guide 114, the guide finger 126 directs the mandrel downwards to the bore 130 as shown in FIG. 6.

The drill string passes through the top drive guide 114 and into the bore 130. The drill string is then stabbed through the rubber 124. As discussed above, the contact of the drill string with the rubber 124 rotates the inner barrel with the drill string.

Referring to FIGS. 4 and 9-12, the sealed lubricating head 112 of the present invention will now be described in more detail. The sealed lubricating head 112 creates two sealed lubricating compartments for lubricating the seals and the bearings. The sealed lubricating head utilizes three different seals, a top seal 138, a middle seal 144, and a bottom seal 150. The top seal 138 is located within top seal carrier 116. Similarly, the bottom seal 150 is located within bottom seal carrier 120.

The rubber 124 attaches to the head 112. The rubber 124 secures to the rubber adapter 122 that attaches to the inner barrel 136. The rubber 124 seals around the drill string when the drill string is stabbed through the rubber 124. The contact of rubber 124 with drill string causes the rubber 124 to rotate with the drill string. As a result, the rotation of the drill string also rotates the inner barrel 136 due to the attachment of rubber 124 with rubber adapter 122 and inner barrel 136.

Figure 9:
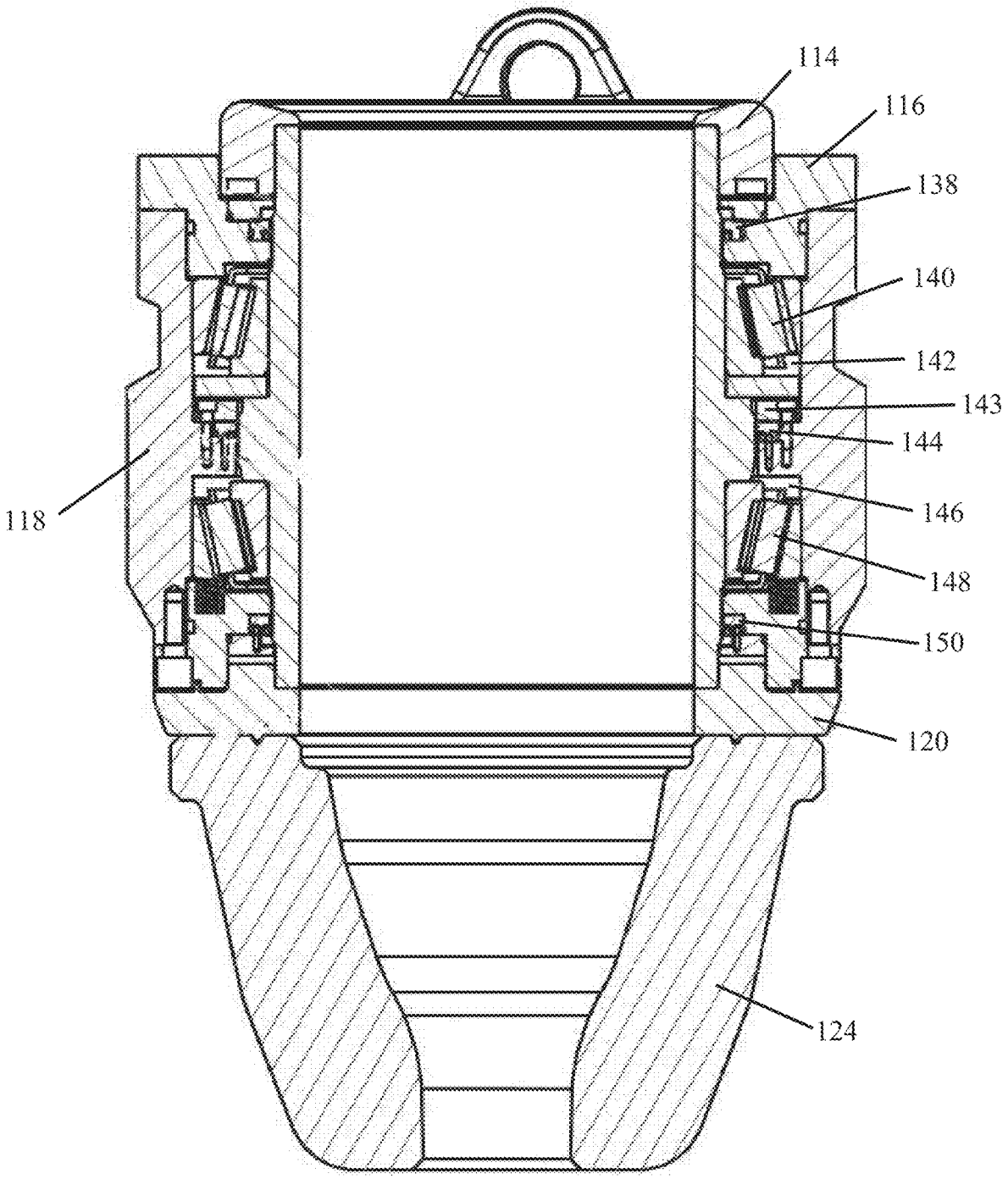
FIG. 9 is a sectional view of one embodiment of the present invention.

Referring to FIG. 9, the lubricating compartments 142, 146 store lubrication to be applied to the bearings 140, 158 located between the outer barrel 118 and the inner barrel 136. The top seal 138 and middle seal 144 form the upper lubricating compartment 142. The middle seal 144 and the bottom seal 150 form the lower lubricating compartment 146.

The top seal carrier 116 attaches to the outer barrel 118 for sealing the upper lubricating compartment 142. The top seal carrier 116 places the top seal 138 adjacent the top seal surface 156. The top seal carrier 116 may be machined to place the top seal 138 at different locations on the top seal surface 156. In another embodiment, the top seal carrier may not be machined to adjust the location of the top seal. The contact between the top seal 138 and the top seal surface 156 seals the upper lubricating compartment 142. In one embodiment, the top seal is secured to the top seal carrier by a fastener, including but not limited to a dowel pin. The attachment of the top seal to the top seal carrier and the outer barrel enables the top seal to remain fixed with the outer barrel.

The middle seal 144 is mounted in the bore of the outer barrel 118. The middle seal 144 is located between the upper lubricating compartment 142 and the lower lubricating compartment 146. The middle seal 144 serves as a seal for both the upper lubricating compartment and the lower lubricating compartment. The middle seal 144 serves to seal the bottom of the upper lubricating compartment 142 and serves to seal the top of the lower lubricating compartment 146. The middle seal 144 may be mounted on different locations in the bore of the outer barrel to increase the contact area with the middle seal surface 158 on the inner barrel. In one embodiment, the middle seal is secured to a retaining plate by a fastener, including but not limited to a dowel pin. The attachment of the middle seal to the retaining plate and the outer barrel enables the middle seal to remain fixed with the outer barrel.

The bottom seal carrier 120 attaches to the outer barrel 118 for sealing the lower lubricating compartment 146. The bottom seal carrier 120 places the bottom seal 150 adjacent the bottom seal surface 160. The bottom seal carrier 120 may be machined to place the bottom seal 150 at different locations on the bottom seal surface 160. In another embodiment, the bottom seal carrier may not be machined to adjust the location of the bottom seal. The contact between the bottom seal 150 and the bottom seal surface 160 seals the lower lubricating compartment 146. In one embodiment, the bottom seal is secured to the bottom seal carrier by a fastener, including but not limited to a dowel pin. The attachment of the bottom seal to the bottom seal carrier and the outer barrel enables the bottom seal to remain fixed with the outer barrel.

In one embodiment, the top seal, bottom seal, and middle seal are secured to the outer barrel. The top seal, bottom seal, and middle seal in such an embodiment do not rotate with the inner barrel. Instead, the top seal, bottom seal, and middle seal remain fixed with the outer barrel.

Figure 10:
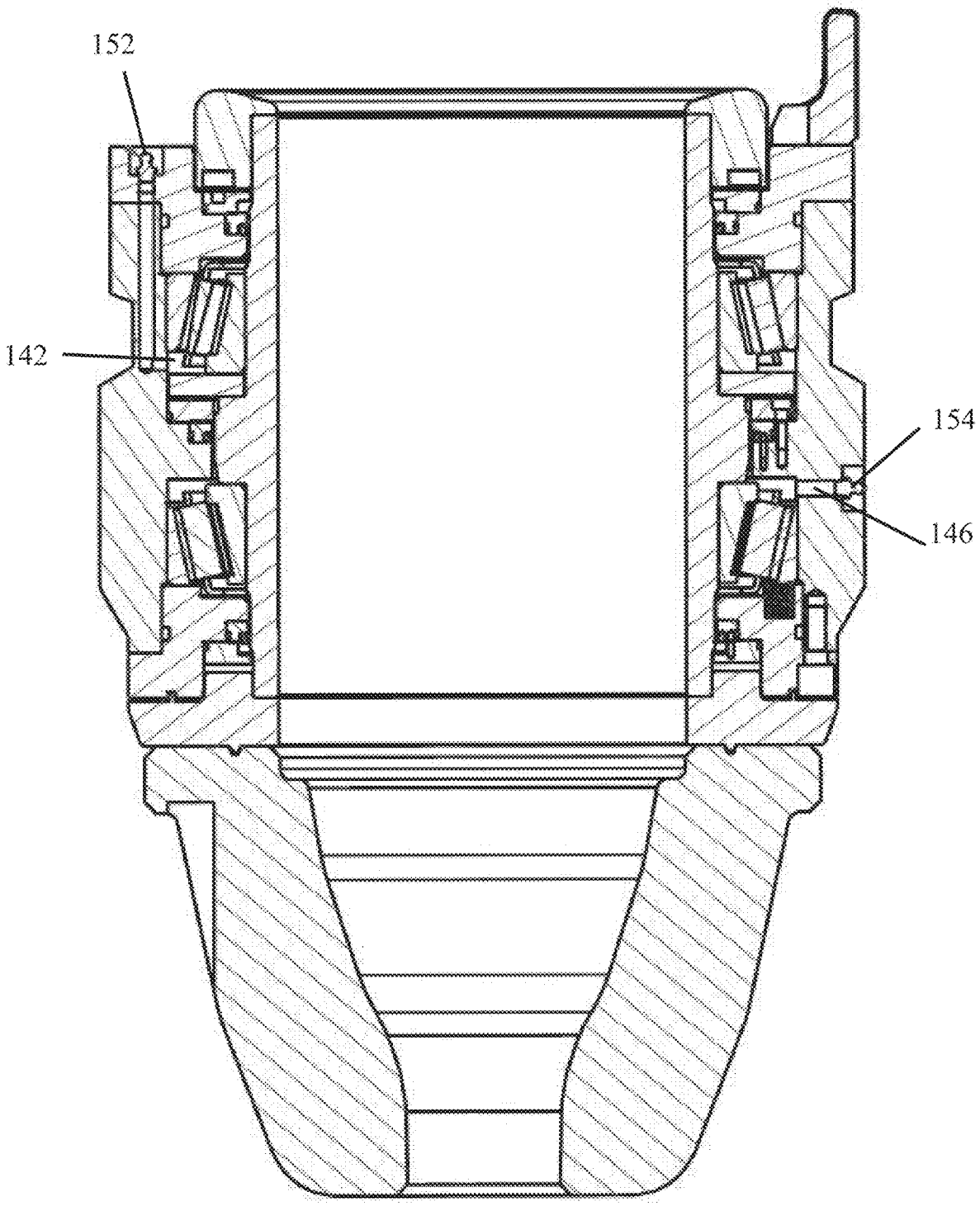
FIG. 10 is a sectional view of one embodiment of the present invention.

FIG. 10 shows the lubricant inlets 152, 154 for applying the lubricant, including, but not limited to oil or grease, to the lubricating compartments 142, 146. Separate inlets provide lubricant to its respective compartment. Upper lubricant inlet 152 supplies upper lubricating compartment 142 with lubricant. Lower lubricant inlet 154 supplies lower lubricating compartment 146 with lubricant.

The sealed lubricating head 112 provides lubrication to bearings 140, 148 in addition to top seal 138, bottom seal 150, and middle seal 144. The lubricant expands to approximately 30% above initial volume as it heats up. The internal pressure also increases as temperature increases. "Thickeners" in the lubricant release oil as the temperature rises.

In one embodiment, the lubricating compartments 142, 146 are filled to ⅔ capacity with lubricant. The initial fill of lubricant covers the bearings 140, 148 located in the lubricating compartments 142, 146. If the lubricating compartments 142, 146 are completely filled with lubricant prior to use, as the head heats up under normal operating parameters, lubricant will be forced out of the seals which would not be permissible.

Each lubricating compartment 142, 146 is filled to ⅔ capacity with lubricant to increase bearing life and bearing lubrication. A coating of lubricant is also applied to the upper top seal 138 prior to operation as lubrication is required for each seal to function as designed. As the head 112 heats up under normal use, the lubricant expands to lube the top seal 138.

The larger bore size of the lubricating head 112 allows rig operators to run larger size bits in the hole. Frequently, large drill bits are pulled up into the RCD while stripping the bits out of the well. These bits may then become lodged in the RCD bore. This causes down time on the rig and higher drilling cost to the driller. This also causes higher refurbishing costs to the manufacturer required by removal of the bit from the equipment. The nine inch bore of one embodiment of the present invention alleviates many of the problems associated with smaller bore equipment.

Figure 11:
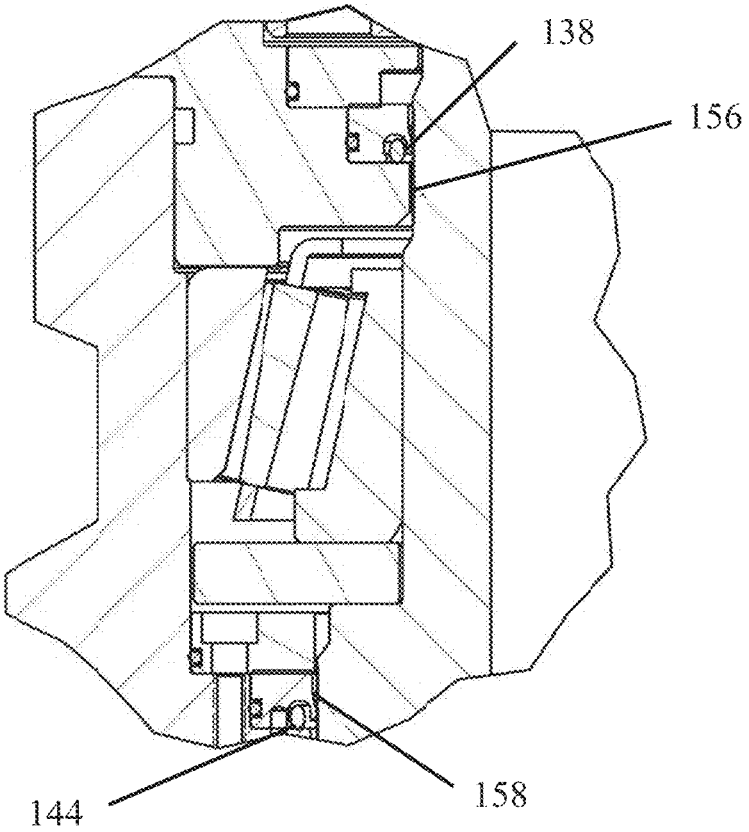
FIG. 11 is a sectional view of a portion thereof.
Figure 12:
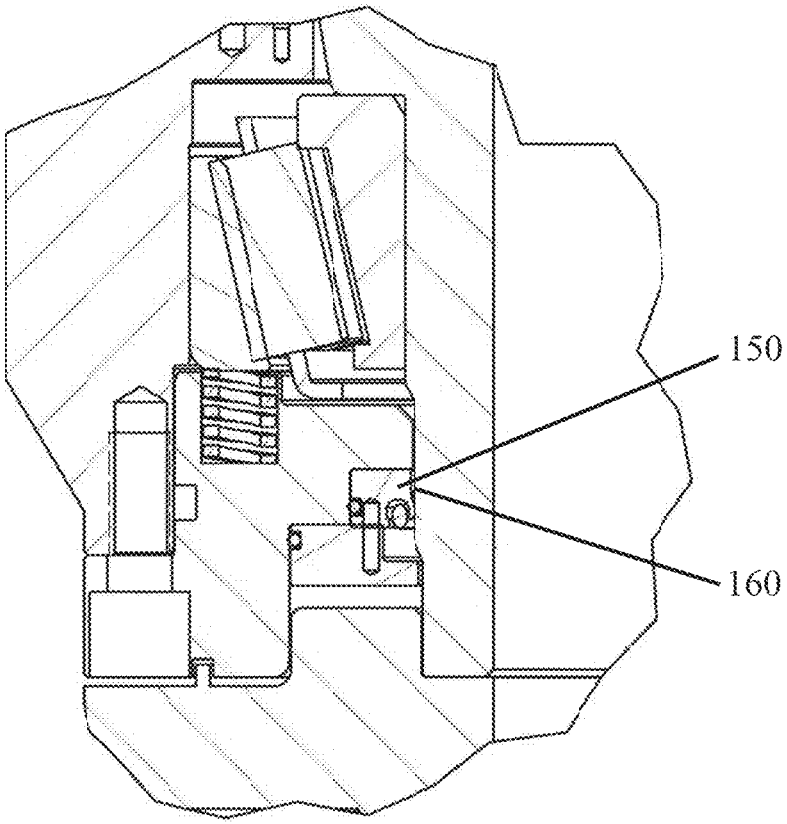
FIG. 12 is a sectional view of a portion thereof.
Figure 13:
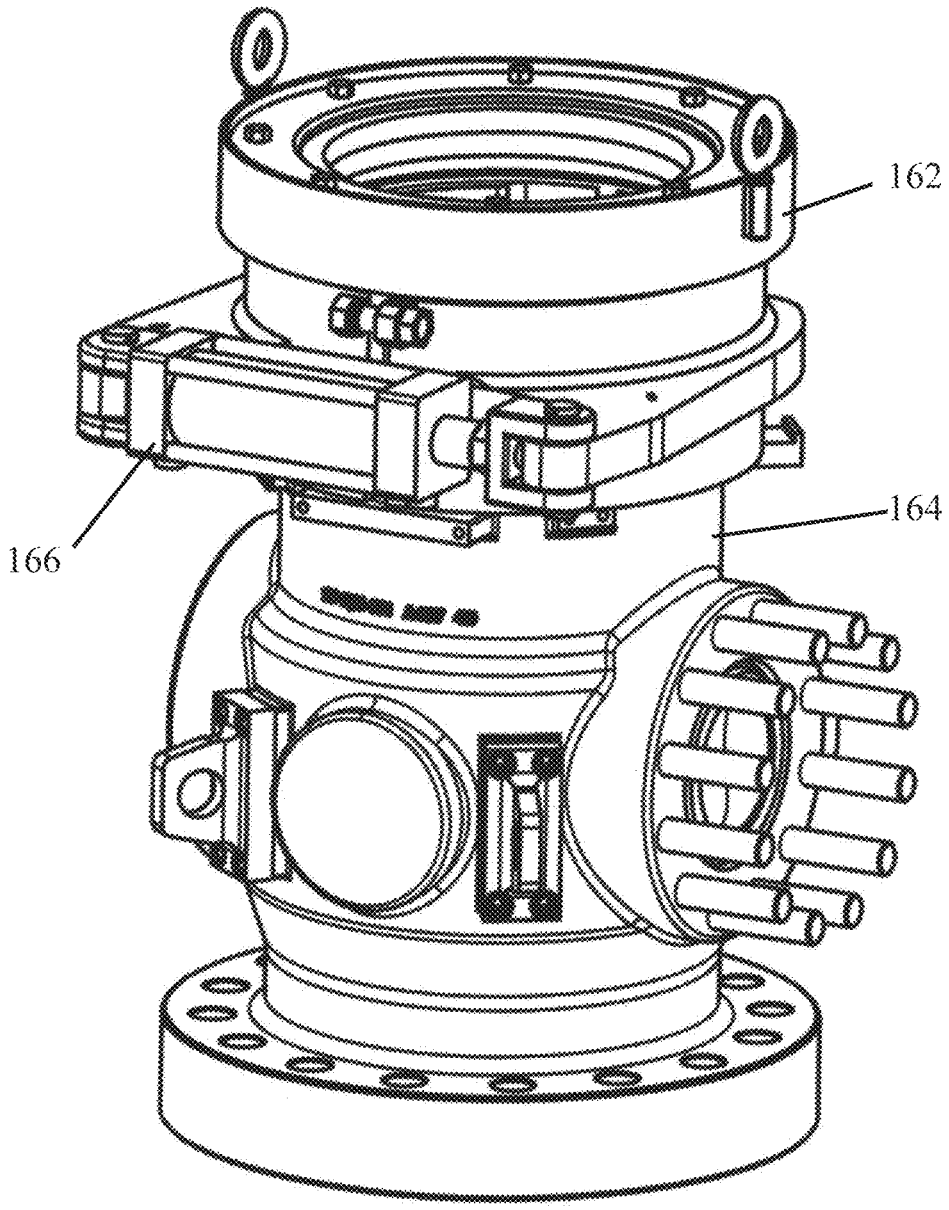
FIG. 13 is an environmental view of one embodiment of the present invention.
Figure 14:
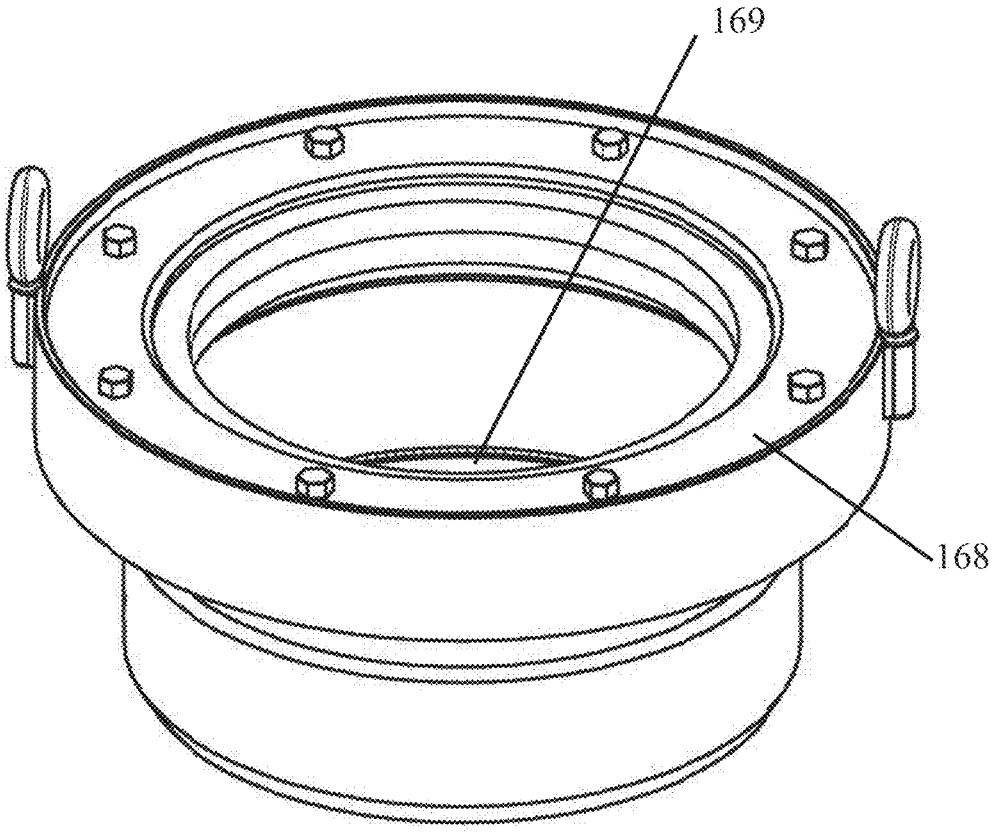
FIG. 14 is an environmental view of one embodiment of the present invention.

FIGS. 11 and 12 show the contact between the seals 138, 144, 150 and the seal surfaces 156, 158, 160. These seals 138, 144, 150 are located at seal cavities within the seal carriers 116, 120. Middle seal 144 is mounted in the bore of the outer barrel 118. A retainer plate 143 is secured to the outer barrel 118. In one embodiment, the retainer plate 143 is bolted to the outer barrel 118. Another fastener, including but not limited to a dowel pin, secures the middle seal 144 to the retainer plate 143.

Each seal 138, 144, 150 contacts a seal surface 156, 158, 160. Each seal surface may be constructed from a tungsten sleeve attached to the inner barrel 136. As the seal surface 156, 158, 160 wears, the seal cavity may be machined again to place the seal 138, 144, 150 at a new location to wear a new area of the seal surface. Each seal contacts its own seal surface. Top seal 138 contacts top seal surface 156. Middle seal 144 contacts middle seal surface 158. Bottom seal 150 contacts bottom seal surface 160.

As the seal surface 156, 158, 160 is depleted, the user may replace the seal surface by attaching a new seal surface on the inner barrel 136. The attachment of a new seal surface allows for a longer life of the inner barrel 136 thus reducing costs and waste.

FIGS. 13-17 show different embodiments of the casing stripper rubber of the present invention. In one embodiment, the casing stripper rubber is used in low pressure RCDs. The casing stripper rubber 162, 168, 170, 172 attaches to the RCD for placement in the bowl 164. A clamp 166 then secures the RCD within the bowl 164. Referring to FIGS. 17-21, the casing stripper rubber 162, 168, 170, 172 is available in many different sizes as required by the specific drilling operation and equipment at the drilling site. For example, the casing stripper 168, 170, 172 is available with inner apertures of 16 inches, 18.625 inches, and 20 inches. The casing strippers 168, 170, 172 are sized for 7 and 1/16 inches to 30 inch bowls.

Figure 15:
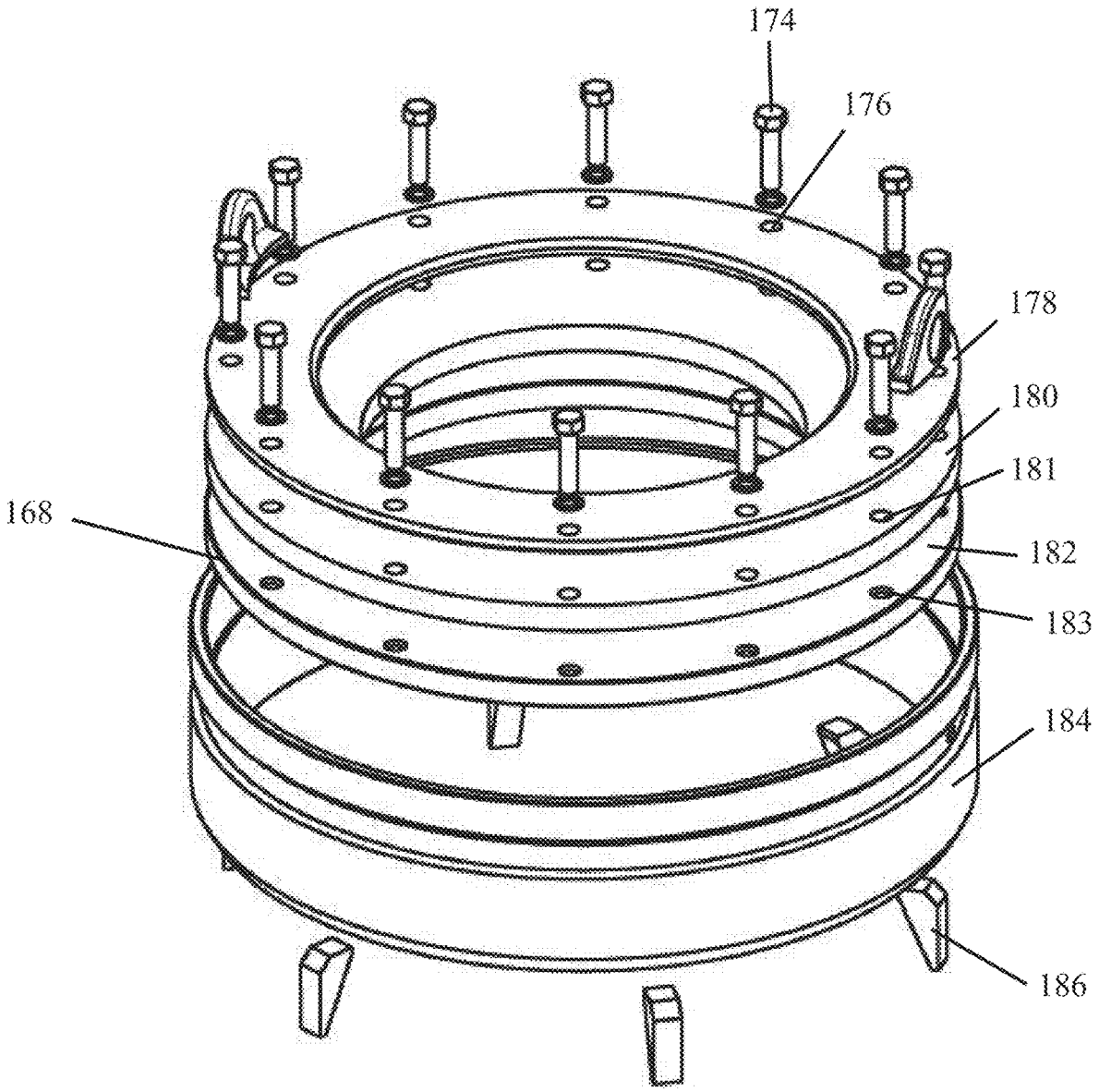
FIG. 15 is an exploded view thereof.
Figure 16:
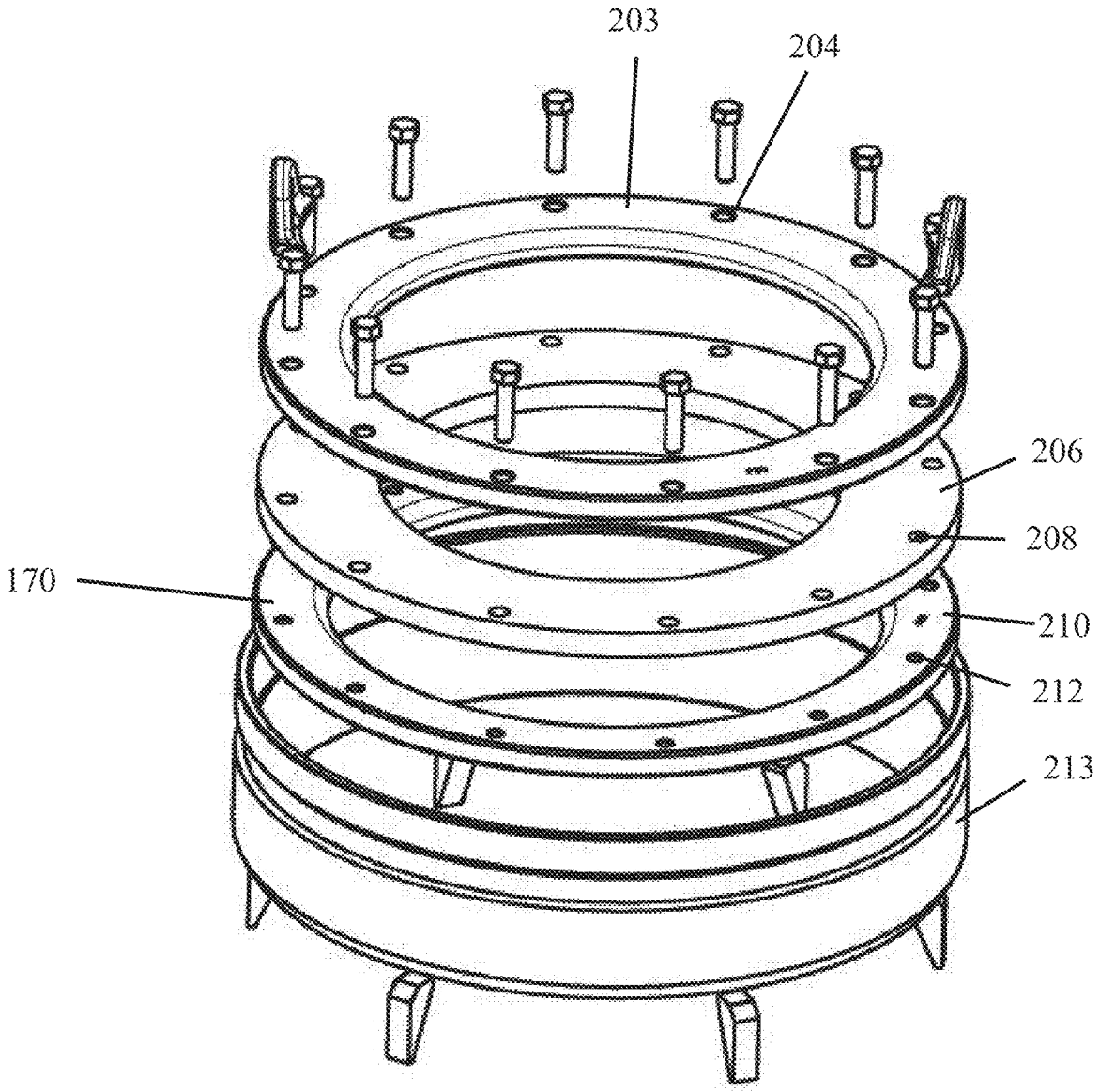
FIG. 16 is an exploded view of one embodiment of the present invention.
Figure 17:
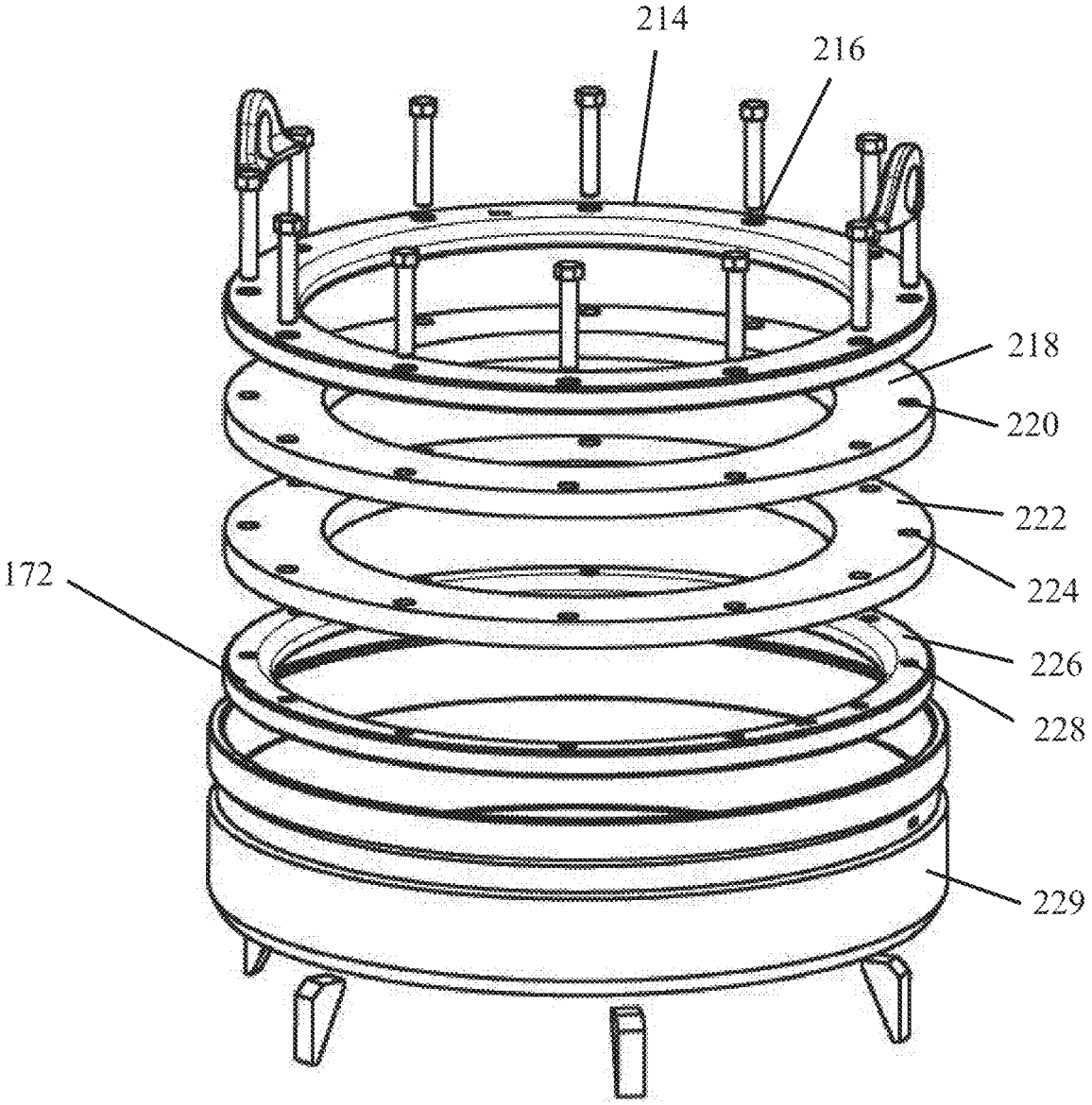
FIG. 17 is an exploded view of one embodiment of the present invention.

FIGS. 15-17 provide additional information regarding the casing stripper rubber. At least one rubber disc 180, 206 as shown in FIGS. 15 and 16 is placed between retainer 178, 203 and a base plate 182, 210. In an embodiment shown in FIG. 17, two rubber discs 218, 222 or more are inserted between the retainer 214 and the base plate 226. The base plates and retainers are constructed from a rigid material, including but not limited to metal, to prevent the rubber discs from being forced down hole.

Fasteners 174 are installed into apertures 176, 204, 216 of the retainer 178, 203, 214, apertures 181, 208, 220, 224 of a rubber disc 180, 206, 218, 222, and apertures 183, 212, 228 of base plate 182, 210, 226 to secure the stripper rubber 168, 170, 172 within the nipple 184, 213, 229. Support fingers 186 located at the interior portion of the nipple 184, 213, 229 prevent the retainer 178, 203, 214, rubber discs 180, 206, 218, 222 and base plate 182, 210, 226 from being forced down hole. The support fingers 186 extend inward from the nipple 184, 213, 228 into the inner aperture formed by the nipple. In one embodiment, the support fingers 186 are sized not to pass into the inner aperture of the corresponding retainer and base plate. By stopping short of the inner aperture, the support fingers 186 do not interfere with placing tools, casing, etc. down hole.

The support fingers 186 and base plates 184, 210, 226 are secured with the nipple 184, 213, 228. In one embodiment, the support fingers 186 and base plates 184, 210, 226 are welded to the nipple 184, 213, 228. The base plate may also be secured to the support fingers by welding the base plate to the nipple and the support fingers. The size of the nipple is selected according to the bowl. The outer wall of the nipple should be sized sufficiently large enough to form an inner aperture 169 sized to allow the casing and any other tools to pass down hole.

Each of the retainers 178, 203, 214; base plates 184, 210, 226; nipples 184, 213, 228; and rubber discs 180, 206, 218, 222 define an inner aperture sized to allow casing and other tools to be inserted down hole. The size of the inner aperture will be sized for the bore for which the stripper rubber is to be used. The outer wall of the retainers 178, 203, 214; base plates 184, 210, 226; and rubber discs 180, 206, 218, 222 will be sized according to the nipples 184, 213, 228.

To create the seal, the disk aperture of the rubber disks is sized smaller than the nipple aperture, the base aperture, and the retainer aperture. In one embodiment, the disk aperture has a smaller diameter than the diameter of the nipple aperture, the diameter of the base aperture, and the diameter of the retainer aperture. The rubber disk when secured with the base, the nipple, and the retainer extends horizontally inward into the inner aperture. Therefore, at least a portion of the rubber disk protrudes horizontally interior of the nipple aperture, the base aperture, and the retainer aperture.

In one embodiment, the retainers and base plates are secured to at least one rubber disc. Fasteners, such as bolts, screws, or other fasteners, secure the retainer, base plate, and rubber discs together. The apertures 216, 220, 224, 228, for example, are aligned with one another. The fasteners are installed into the apertures securing the base plate, the top retainer, and the rubber discs. In the embodiment in which the base plate is secured to the drilling nipple, the fasteners secure the top retainer and rubber discs with the base plate and the nipple to secure the stripper rubber within the nipple.

FIGS. 18-48 show another embodiment of the sealed lubricating head 300 and the bore 326 within the inner barrel 318 and the outer barrel 306. The top drive guide 302 replaces the Kelley drive to allow for rotation of the inner barrel.

Rubber adapter 310 secures to the inner barrel 306. The rubber 298 attaches to the rubber adapter 310 via fasteners 296 through attachment apertures 360. Threaded fasteners, such as bolts secure the rubber to the rubber adapter 310 via the attachment apertures 360.

Rubber 298 attaches to the rubber adapter 310. The rubber seals the drilling string. A drilling string is inserted or "stabbed" through the rotating head assembly to seal the drilling string. A seal 299 extends downward from the rubber adapter 310 to contact the rubber 298 to seal against the rubber adapter 310 and the rubber 298.

Top seal carrier 304 secures to the outer barrel 306 and provides a cavity for placement of the top seal 312. Bottom seal carrier 328 secures to the outer barrel 306 and provides a cavity for placement of the bottom seal 322. The top seal 312 and bottom seal 322 create a sealed lubricating compartment 313 between the outer barrel 306 and the inner barrel 318.

Figure 18:
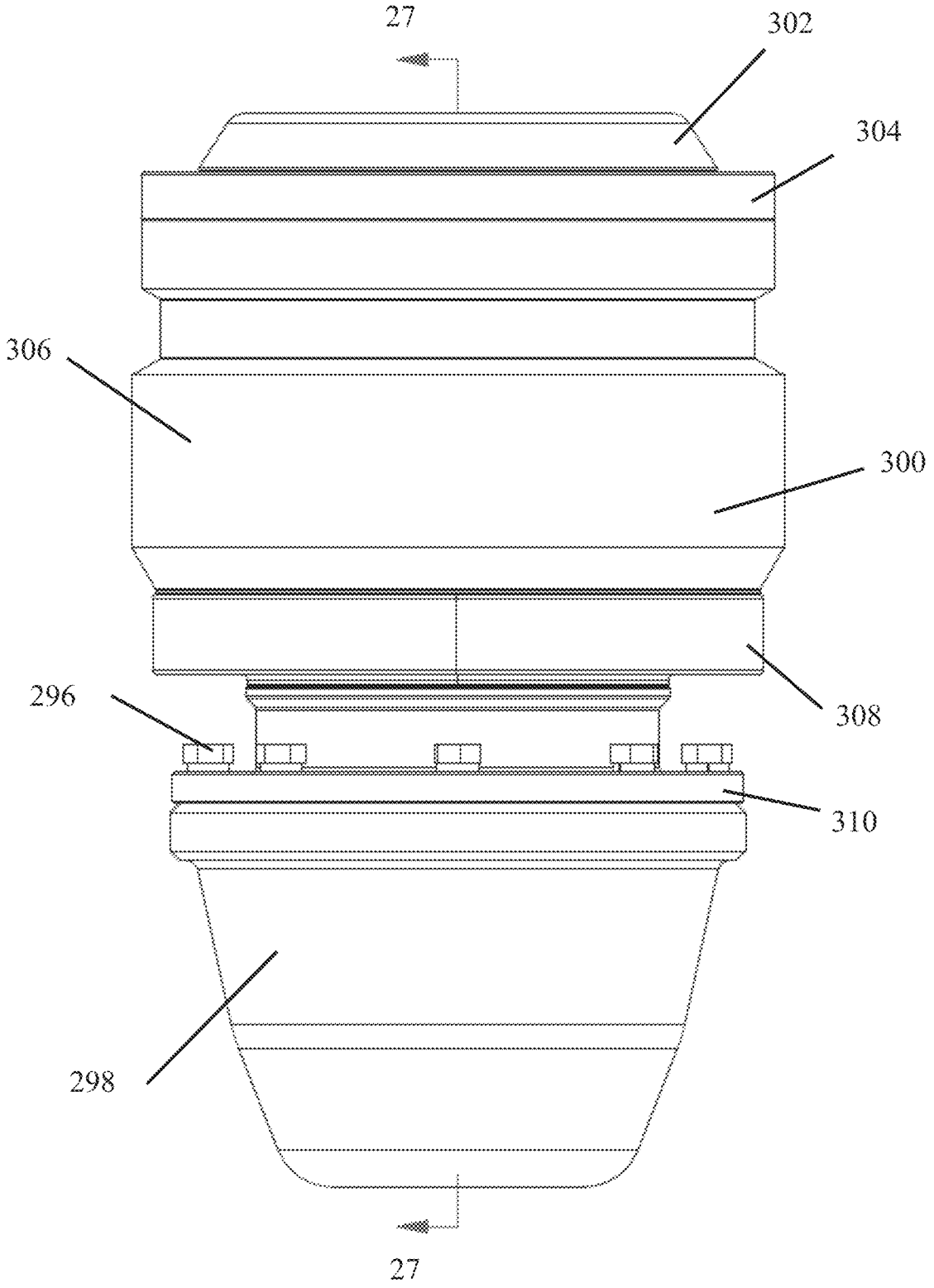
FIG. 18 is an environmental view of one embodiment of the present invention.
Figure 19:
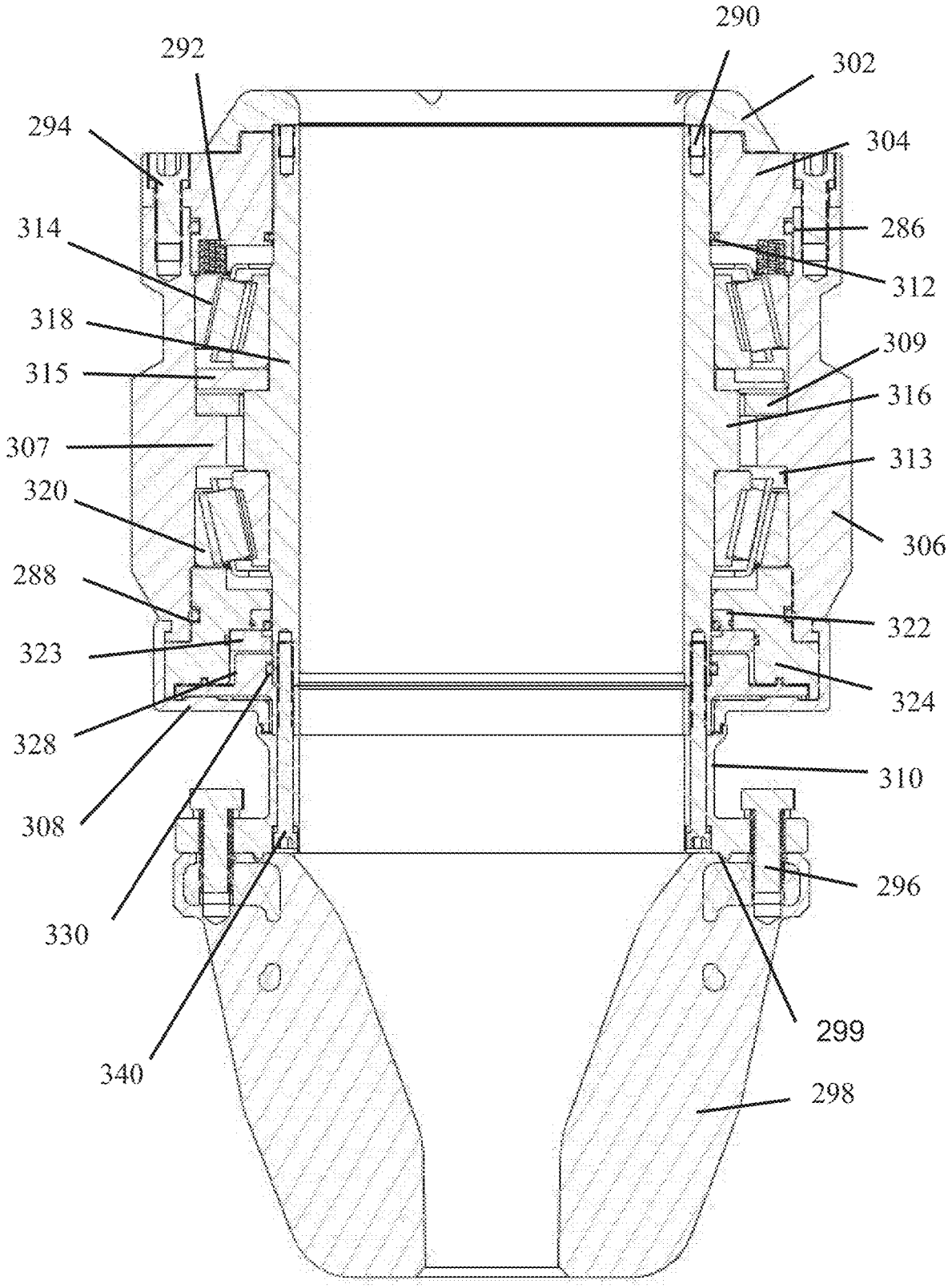
FIG. 19 is a sectional view thereof.

Referring to FIGS. 18-19, top drive guide 302 directs the drill string into the bore 326. The top drive guide 302 secures to the inner barrel 318.

Top seal carrier 304 provides a cavity for placement of seal 312. Top seal carrier 304 secures to the outer barrel 306 via fasteners 294.

Debris cover 308 limits the debris and other contaminants from entering the rotating head assembly. Rubber adapter 310 secures the debris cover 308 to the rotating head assembly. At least a portion of the rubber adapter 310 is located radially outward of the debris cover 308 to secure the debris cover 308 to the rotating head assembly.

FIG. 19 shows a sectional view showing additional components of the rotating head assembly. Fasteners 290 secure the top drive guide 302 to the inner barrel 318. The top drive guide 302 provides a curvature that guides the drill string into the bore 326.

Fasteners 294 secure the top seal carrier 304 to the outer barrel 306. The top seal carrier 304 provides a cavity for placement of the seal 312 against inner barrel 318. The top seal carrier 304 can be machines to adjust the positioning of the cavity. The adjustment of the cavity of top seal carrier 304 changes the positioning of the seal 312 against the inner barrel 318.

Spring 292 loads the bearing 314. The top seal carrier 304 located above the spring 292 provides a surface for the spring 292 to load bearing 314.

Flange 316 of inner barrel 318 provides a lower surface for contacting bearing 320. Bearing 320 is located between an interior flange of the outer barrel 306 and the bottom seal carrier 324. Bottom seal carrier 324 provides a cavity for placement of the seal 322 and seal 288. Seal 322 is located radially inward to contact the inner barrel 318. Seal 288 is located radially outward for contacting the outer barrel 306.

Rubber adapter 310 provides a two component tool having head 328. Rubber adapter head 328 provides a cavity for placement of seal 330, such as an O-ring, against the inner barrel 318.

The rubber adapter 310 secures the rubber 298 to the rotating head assembly. Fasteners 340 secure the rubber adapter 310 to the inner barrel 318. Fasteners 296 secure the rubber 298 to the rubber adapter 310. Fasteners 340 secure the rubber adapter 310 and the rubber adapter head 328 to the inner barrel 318.

Figure 20:
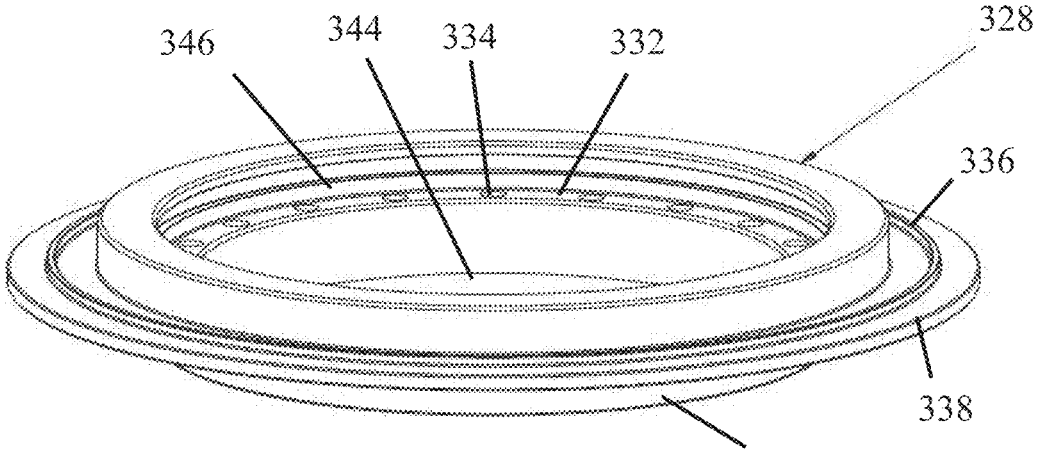
FIG. 20 is a perspective view of a component of one embodiment of the present invention.
Figure 21:
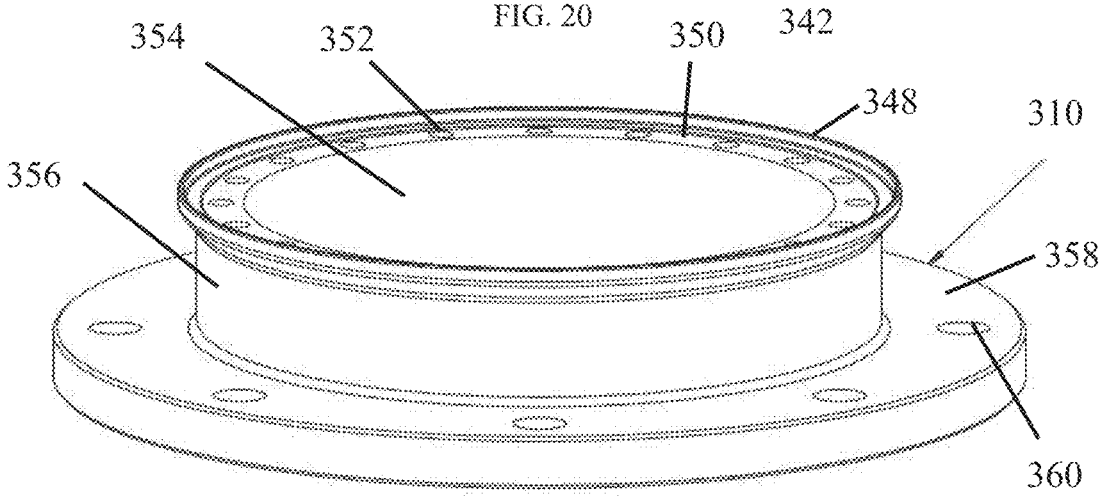
FIG. 21 is a perspective view of a component of one embodiment of the present invention

FIGS. 20 and 21 show the rubber adapter 310 and rubber adapter head 328. The rubber adapter head 328 secures vertically above the rubber adapter 310. Bores 344, 354 located centrally of the rubber adapter 310 and the rubber adapter head 328 align with the bore 326.

An inner surface 332 provides an attachment aperture 334. The inner surface 332 contacts the inner barrel 318. The inner surface 332 is located radially interior of the upper surface of the rubber adapter head 328.

Cavity 346 located between the upper surface and the inner surface 332 accepts a seal, such as seal 330, shown in FIG. 19. Seal 330 contacts the inner barrel 318.

Rubber adapter head 328 also assists with attaching the bottom seal carrier 324 to the rotating head assembly. Flange 338 extends radially outward from bore 344. Lip 336 extends upward from flange 338. Lip 336 inserts into a recess of the bottom seal carrier 324 as shown in FIG. 19.

Neck 342 of the rubber adapter head 328, as shown in FIGS. 19-21, extends downward towards rubber adapter 310. Upper lip 348 of the rubber adapter 310 is located radially outward of neck 342. The bottom surface of the rubber adapter head 328 contacts surface 350 of the rubber adapter 310.

Fasteners 340 secure rubber adapter 310 to rubber adapter head 328 as shown in FIG. 19. Apertures 334, 352 extend through rubber adapter 310 and rubber adapter head 328 as shown in FIG. 19. Fasteners 340 secure the rubber adapter 310 and rubber adapter head 328 to the inner barrel 318.

Adapter body 356 provides some vertical distance between the flange 350 and lip 348. Such height provides the user with some working room to attach and detach rubber 298 to the flange 358 via fasteners into attachment apertures 360.

Figure 22:
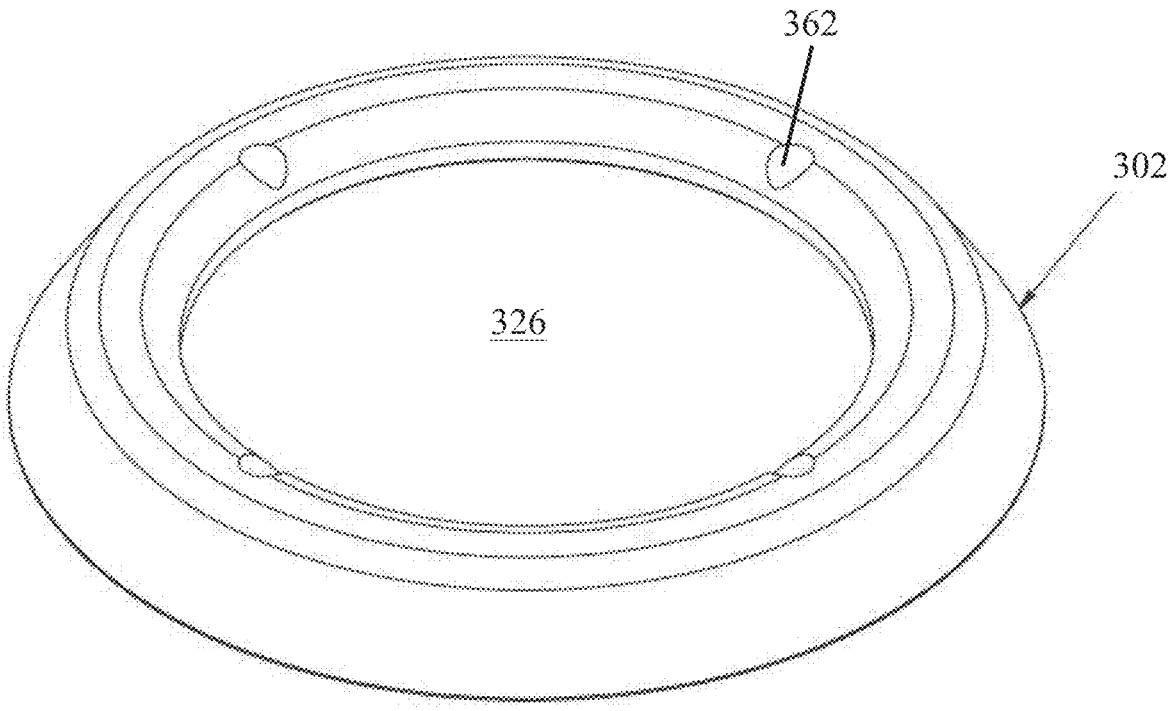
FIG. 22 is a perspective view of a component of one embodiment of the present invention.
Figure 23:
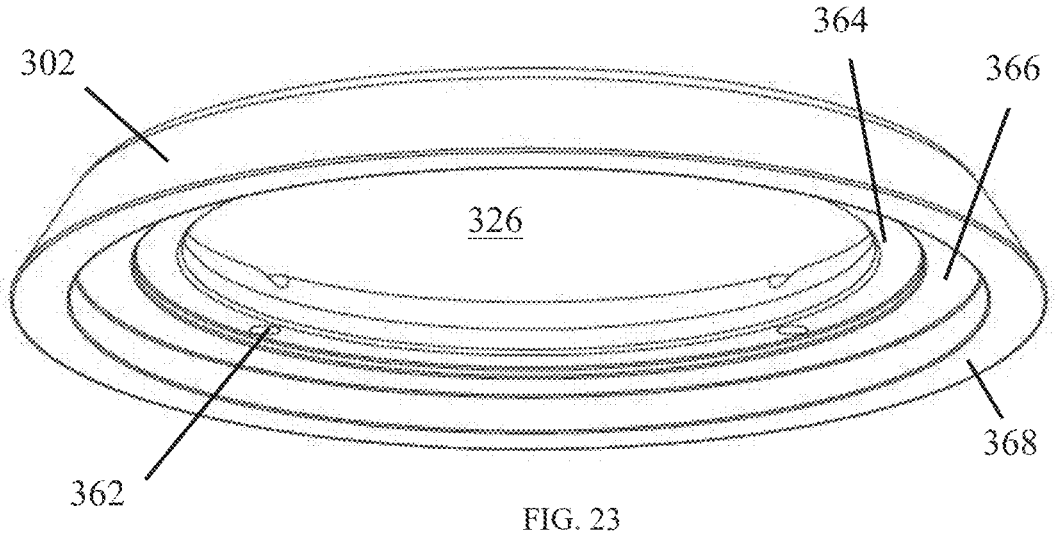
FIG. 23 is a perspective view thereof.

FIGS. 22 and 23 show the top drive guide 302 and bore 326 through the top drive guide 302. The upper surface of top drive guide 302 directs downhole tools and equipment inserted from above top drive guide 302 towards bore 326.

Attachment apertures 362 accept fasteners 290 to secure the top drive guide 302 to the inner barrel 318 as shown in FIG. 19. Barrel contact surface 364 is located radially outward from the bore 326. Attachment aperture 362 passes through the barrel contact surface 364. Barrel contact surface 364 contacts the inner barrel 318 when top drive guide 302 attaches to the rotating head assembly.

Middle surface 366 is located radially outward from the barrel contact surface 364. Middle surface 366 is located vertically below the barrel contact surface 364. The middle surface 366 provides clearance above the top seal carrier 304 when the top drive guide 302 attaches to the rotating head assembly.

Bottom surface 368 is located radially outward from the barrel contact surface 364 and middle surface 366. Bottom surface 368 is located vertically below the barrel contact surface 364 and middle surface 366. The bottom surface 368 provides clearance above the top seal carrier 304 when the top drive guide 302 attaches to the rotating head assembly.

The bottom surface 368 is located radially outward from an upper portion of the top seal carrier 304 as shown in FIG. 19. Bottom surface 368 also provides radial clearance exterior of the upper portion of the seal carrier 304.

Figure 24:
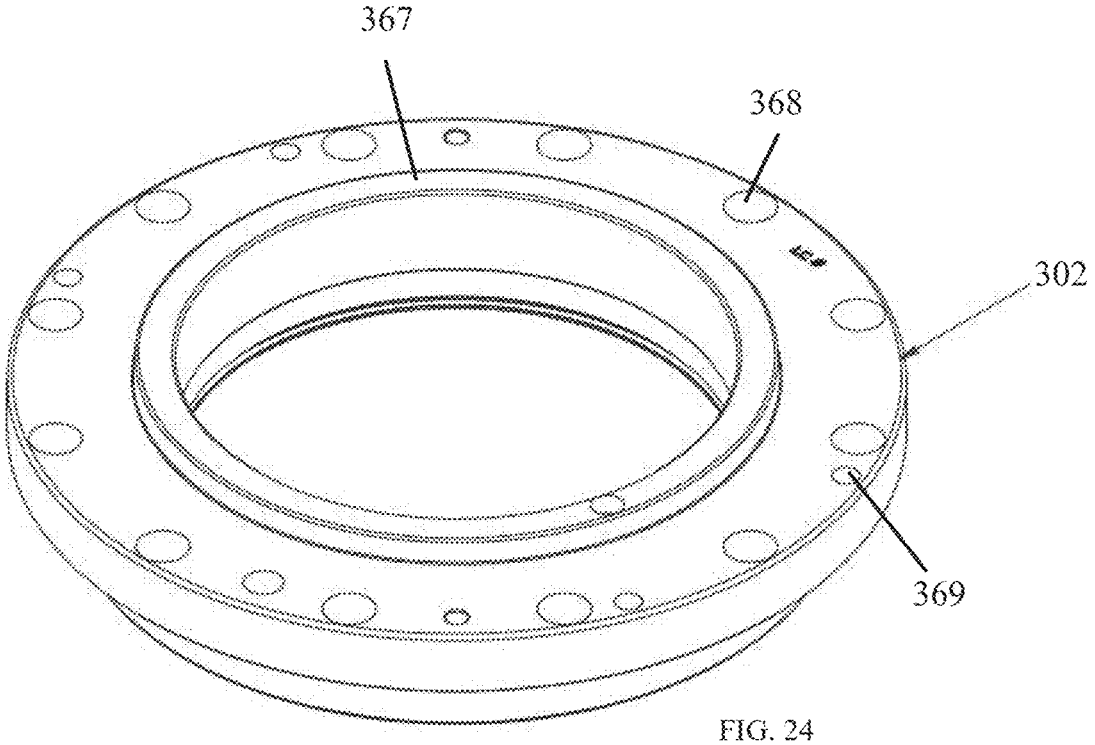
FIG. 24 is a perspective view of a component of one embodiment of the present invention.
Figure 25:
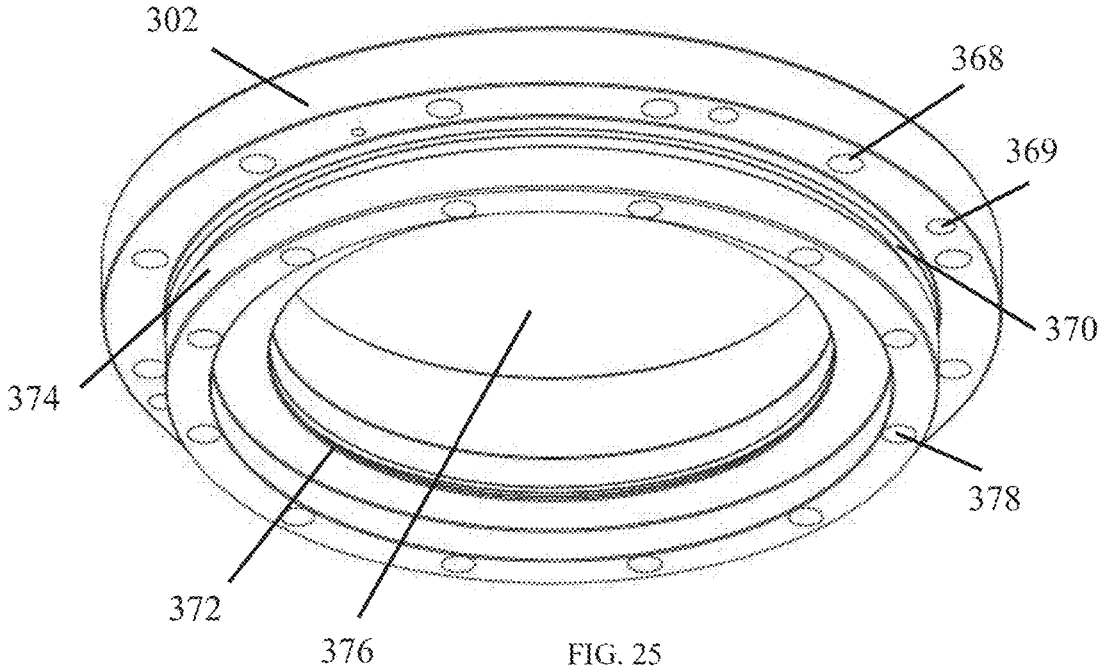
FIG. 25 is a perspective view thereof.

FIGS. 24 and 25 show the top seal carrier 302. Neck 367 of the top seal carrier 302 extends vertically upward above the flange into the top drive guide 302 as shown in FIG. 19. Attachment apertures 368, 369 extend through the flange for attaching the top seal carrier 302 to the outer barrel 306 via fasteners 294.

Leg 374 extends vertically downward from the flange of top seal carrier 302. Leg 374 is located radially inward from the attachment apertures 368, 369 and radially outward from the central aperture 376. A radially outer surface of leg 374 provides seal cavity 370 for placement of a seal 286, such an O-ring, against the outer barrel 306 as shown in FIG. 19.

Top seal carrier 302 also provides a radially inner cavity 372 for placement of seal 312 adjacent aperture 376. Cavity 372 places the seal 312 adjacent the inner barrel 318.

Bottom surface of the top seal carrier 302 provides loading apertures 378. These loading apertures 378 accept springs 292 as shown in FIG. 19. These springs 292 load the bearing 314. Loading apertures 378 do not pass completely through the top seal carrier 302.

Figure 26:
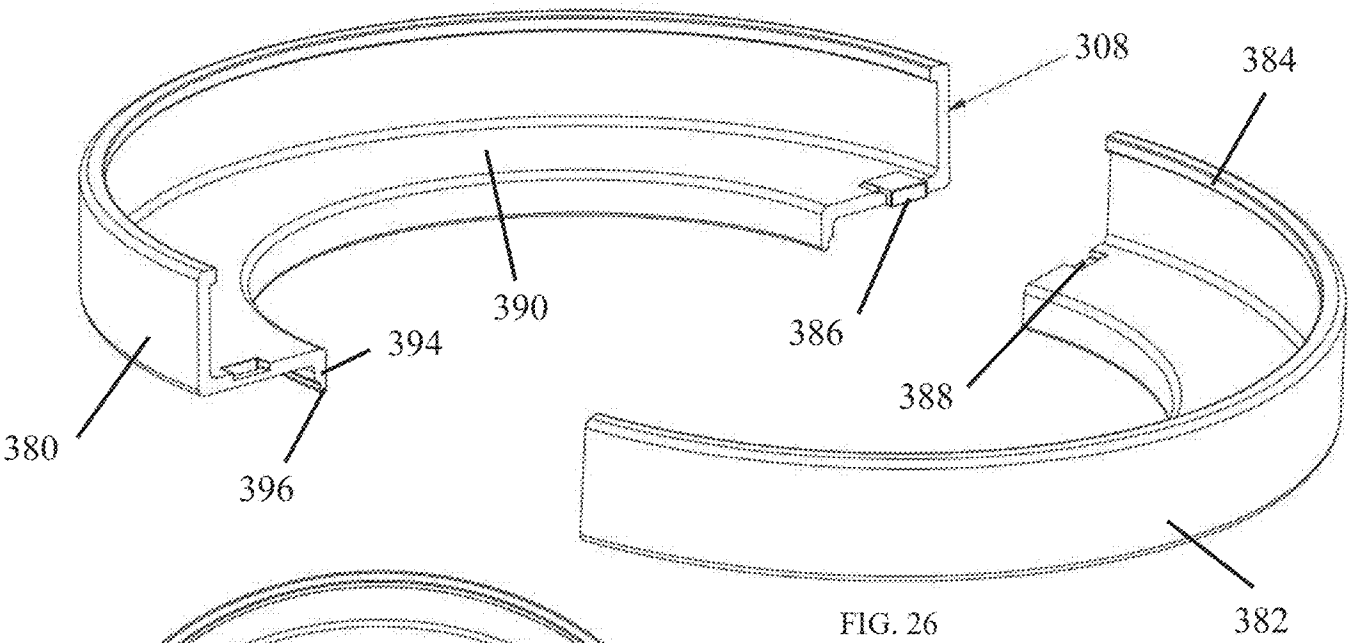
FIG. 26 is a perspective view of a component of one embodiment of the present invention.
Figure 28:
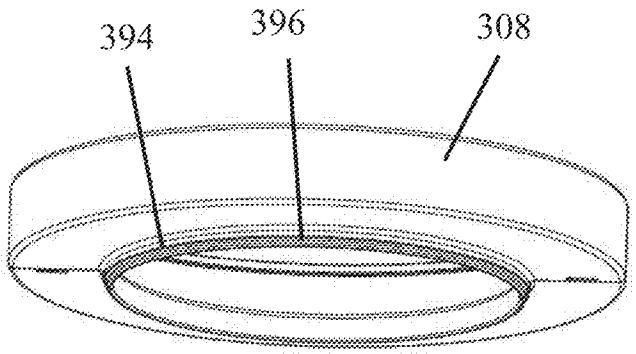
FIG. 28 is a perspective view thereof.
Figure 27:
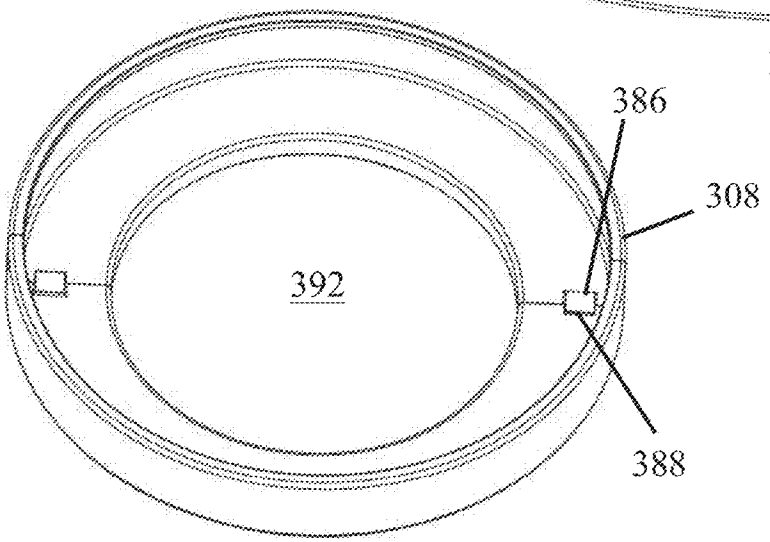
FIG. 27 is a perspective view thereof.

FIGS. 26-28 show the debris cover 308. Debris cover 308 provides debris bodies 380, 382 for installing the debris cover 308. The two piece components of debris cover 308 simplify the installation and removal of the debris cover 308. Each debris body provides an attachment finger 386 and attachment recess 388. Attachment finger 386 inserts into attachment recess 388 for securing the attachment bodies to each other to form the debris cover 308.

Attachment lip 384 inserts into a recess in the outer barrel 306 as shown in FIG. 19. The attachment lip 384 extends radially inward into the recess of outer barrel 306.

Guard surface 390 extends radially outward from central aperture 392. Guard surface 390 provides a barrier that limits debris and other contaminants from entering the rotating head assembly.

Guard leg 394 extends vertically downward from guard surface 390. Guard leg 394 is located radially inward of the attachment lip 384. The guard leg 394 provides guard foot 396. Guard foot 396 is located radially inward of an upper portion of the rubber adapter 310. Rubber adapter 310 contacts the guard foot 396 to secure the debris cover 308 to the rotating head assembly.

Figure 30:
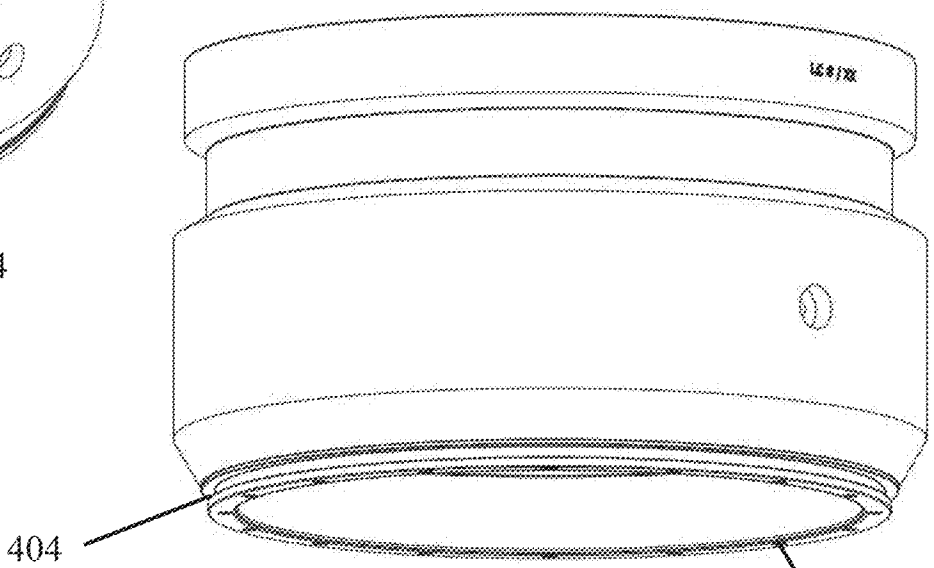
FIG. 30 is a perspective view thereof.
Figure 29:
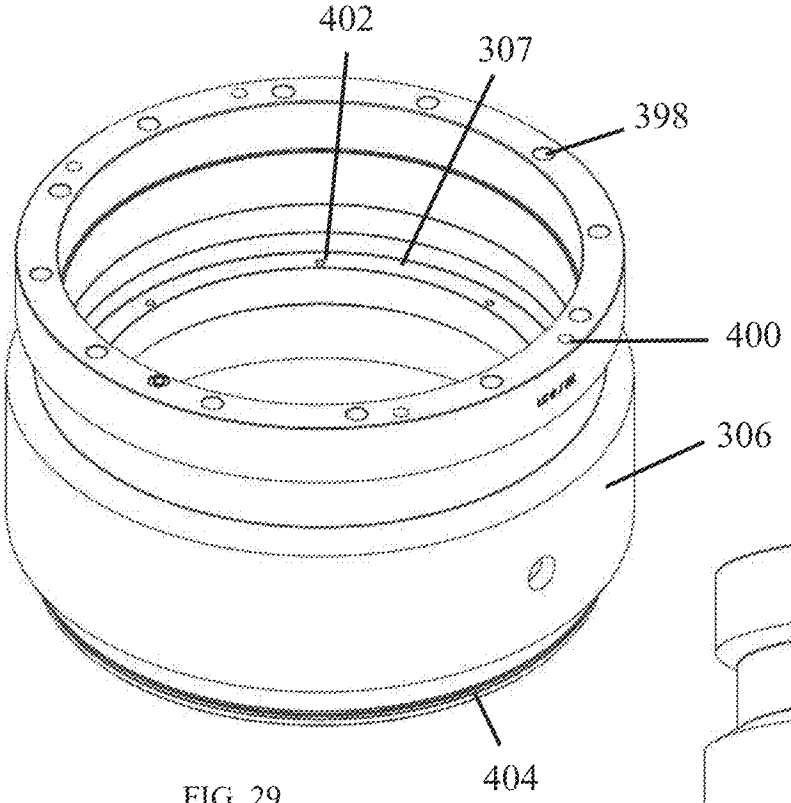
FIG. 29 is a perspective view of a component of one embodiment of the present invention.

FIGS. 29-30 show the outer barrel 306. The outer barrel 306 remains stationary allowing the inner barrel to rotate. Attachment apertures 398, 400 accept fasteners 294 to secure the top seal carrier 304 to the outer barrel 306 as shown in FIG. 19. Flange 316 provides an upper surface with attachment apertures 402. Attachment apertures 402 accept fasteners to attach a seal retainer 309 above the flange 307. The seal retainer 307 is located vertically below the bearing 314 and seal retainer 315 as shown in FIG. 19.

Seal retainer 309 extends radially inward towards the bore. Seal retainer 315 extends radially outward from the bore towards the outer barrel 306. The seal retainers 307, 315 contact each other to prevent the inner barrel from falling downhole through the bore. The seal retainers 309, 315 limit the vertical downward movement of the inner barrel through the bore.

Attachment foot 404 creates a cavity for placement of lip 384 of debris cover 308. Lip 384 installs the debris cover 308 on the outer barrel 306 at attachment foot 404 as shown in FIGS. 19 and 30.

Figure 31:
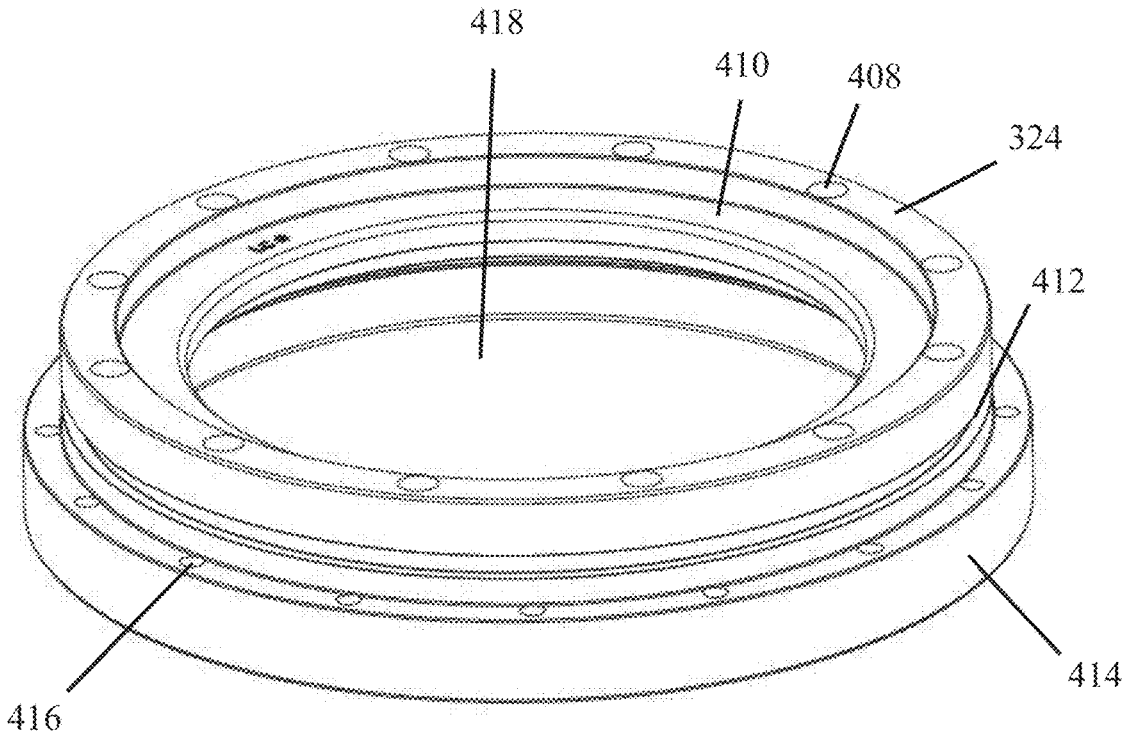
FIG. 31 is a perspective view of a component of one embodiment of the present invention.
Figure 32:
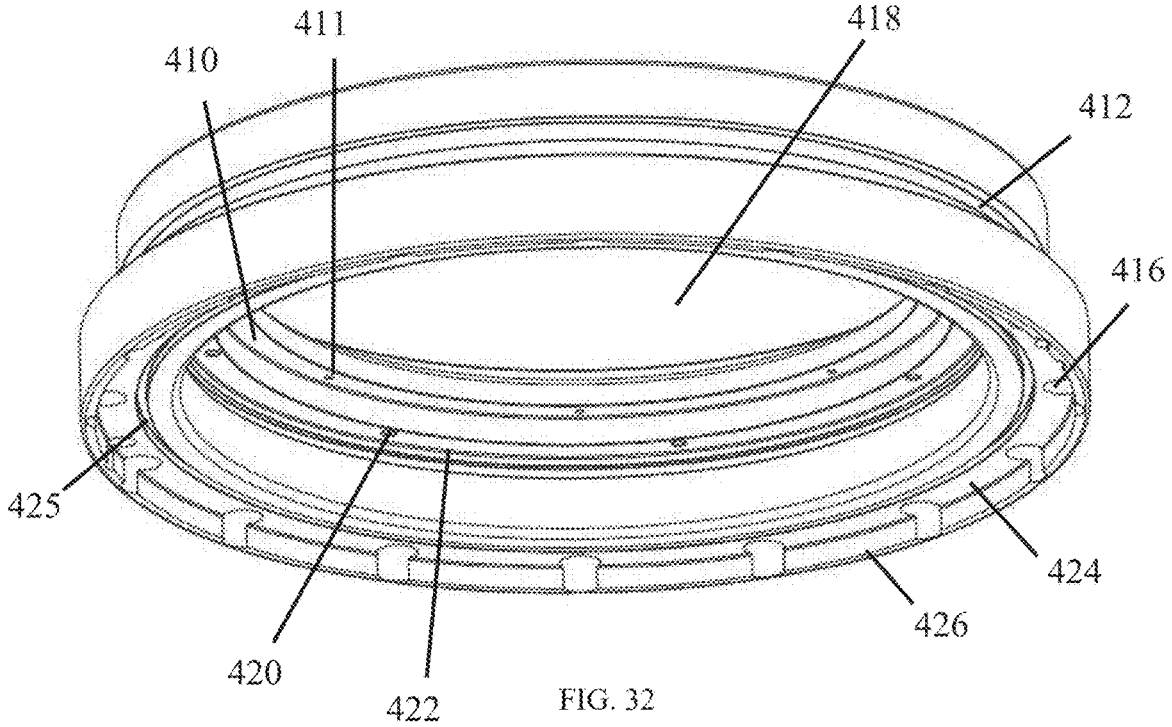
FIG. 32 is a perspective view thereof.

FIGS. 31 and 32 show the bottom seal carrier 324 with central aperture 418. Bottom seal carrier 324 places two seals within the rotating head assembly. The bottom seal carrier 324 places inner seal 322 adjacent the inner barrel 318 and outer seal 288, such as an O-ring, adjacent the outer barrel 308 as shown in FIG. 19.

Seal surface 410 provides attachment apertures 411 for attaching seal 322 to bottom seal carrier 324. The seal 322 attaches vertically below the seal surface 410. Seal surface 410 places seal 322 adjacent the inner barrel for sealing between the bottom seal carrier 324 and the inner barrel.

Support surface 422 is located radially outward from seal surface 410 and seal 322. Support surface 422 is also located vertically below the seal surface 410. Support surface 422 attaches to lower retainer 323 located below the support surface 422 as shown in FIG. 19. Fasteners insert into attachment apertures 420 to attach the lower retainer 323 to the support surface 422 as shown in FIG. 19.

Recess 422 extends vertically upward from a lower surface 424. Recess 422 accepts lip 336 from rubber adapter 310 as shown in FIGS. 19-20 and 32.

Fasteners insert into attachment apertures 416 to secure the bottom seal carrier 324 to the outer barrel 306. Leg 426 extends downward from the lower surface 424. Leg 426 extends downward radially outward from the rubber adapter head 328 as shown in FIGS. 19 and 32.

Figure 34:
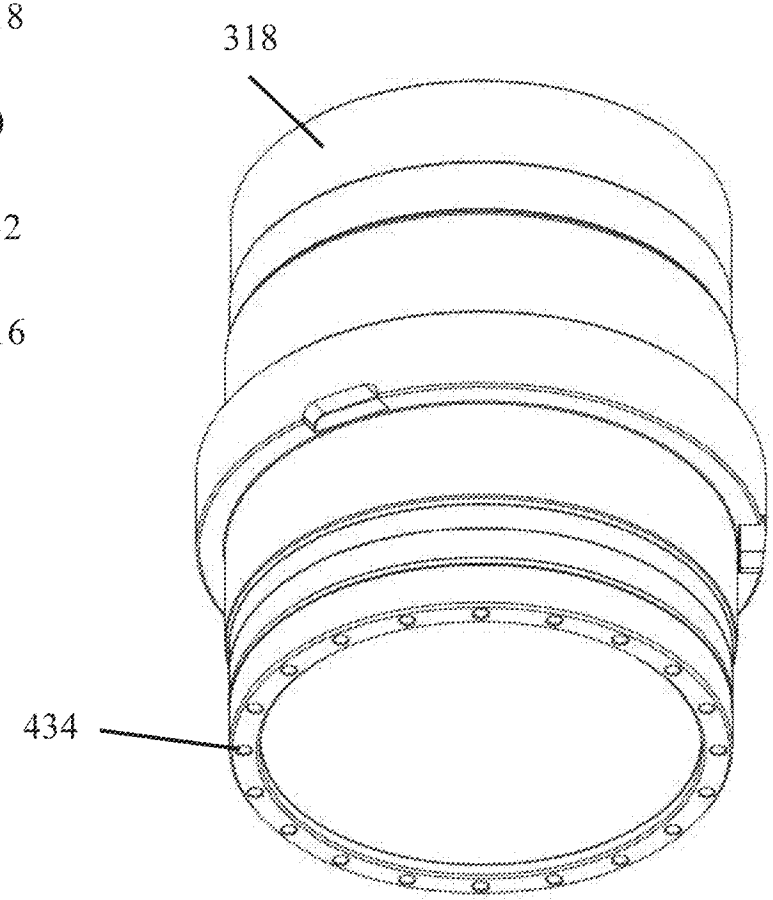
FIG. 34 is a perspective view thereof.
Figure 33:
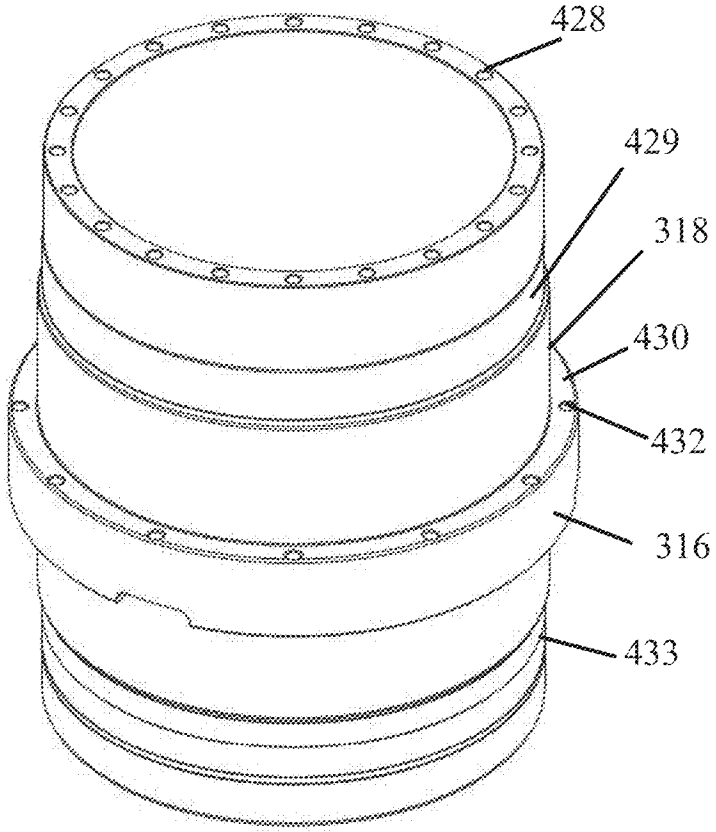
FIG. 33 is a perspective view of a component of one embodiment of the present invention.

FIGS. 33 and 34 show the inner barrel 318 with wear surfaces 429, 433. The seals 312, 330 contact wear surfaces 429, 433 to seal and reduce damage to bearings 314, 320. Inner barrel 318 rotates in relation to seal carriers 304, 324 and the seals 312, 322 located within the seal cavities of seal carriers 304, 324. Therefore, as inner barrel 118 rotates in relation to seals 312, 330, wear surfaces 429, 433 erode at the contact point of the seals 312, 330 and wear surfaces 429, 433 during drilling operations.

Over a period of use, wear surfaces 429, 433 deteriorate such that the bearing elements 314, 320 are not properly enclosed. To prevent damage to bearing elements 314, 320, seal cavities of seal carriers 304, 324 are re-machined to adjust the location of the seals 312, 322 to an unused portion of wear surfaces 429, 433. Because seal carriers 304, 324 do not vertically move in relation to inner barrel 318 and wear surfaces 429, 433, the seals 312, 322 erode a concentric ring around wear surfaces 429, 433.

After wear surfaces 429, 433 have eroded such that the seals 312, 322 no longer properly protect bearings 314, 320, the present invention allows re-machining of the seal cavities of seal carriers 304, 324 to vertically displace the seals 312, 322. The vertically displaced seals 312, 322 now contact an unused area of wear surfaces 429, 433. Because the wear surfaces 429, 433 erode in a concentric manner, the seals 312, 322 will not contact the deteriorated areas of wear surfaces 429, 433 during rotation of inner barrel 318 in relation to outer barrel 306.

By adjusting the location of the seals 312, 322 to an unused portion of wear surfaces 429, 433, seals 312, 322 and wear surfaces 429, 433 properly enclose bearing elements 314, 320. Thus, the adjusted seals 312, 322 prevent unnecessary damage to the rotating head assembly. The newly relocated seals 312, 322 will now wear an unused area of the same integrated wear surfaces 429, 433 of the inner barrel 318 such that the present invention utilizes the entire wear surfaces 429, 433 of the inner barrel 318.

Flange 316 provides an upper surface 430 with attachment apertures 432. A central retainer 315 attaches to the flange 316 via fasteners installed through central retainer 315 into the attachment apertures 432.

Figure 35:
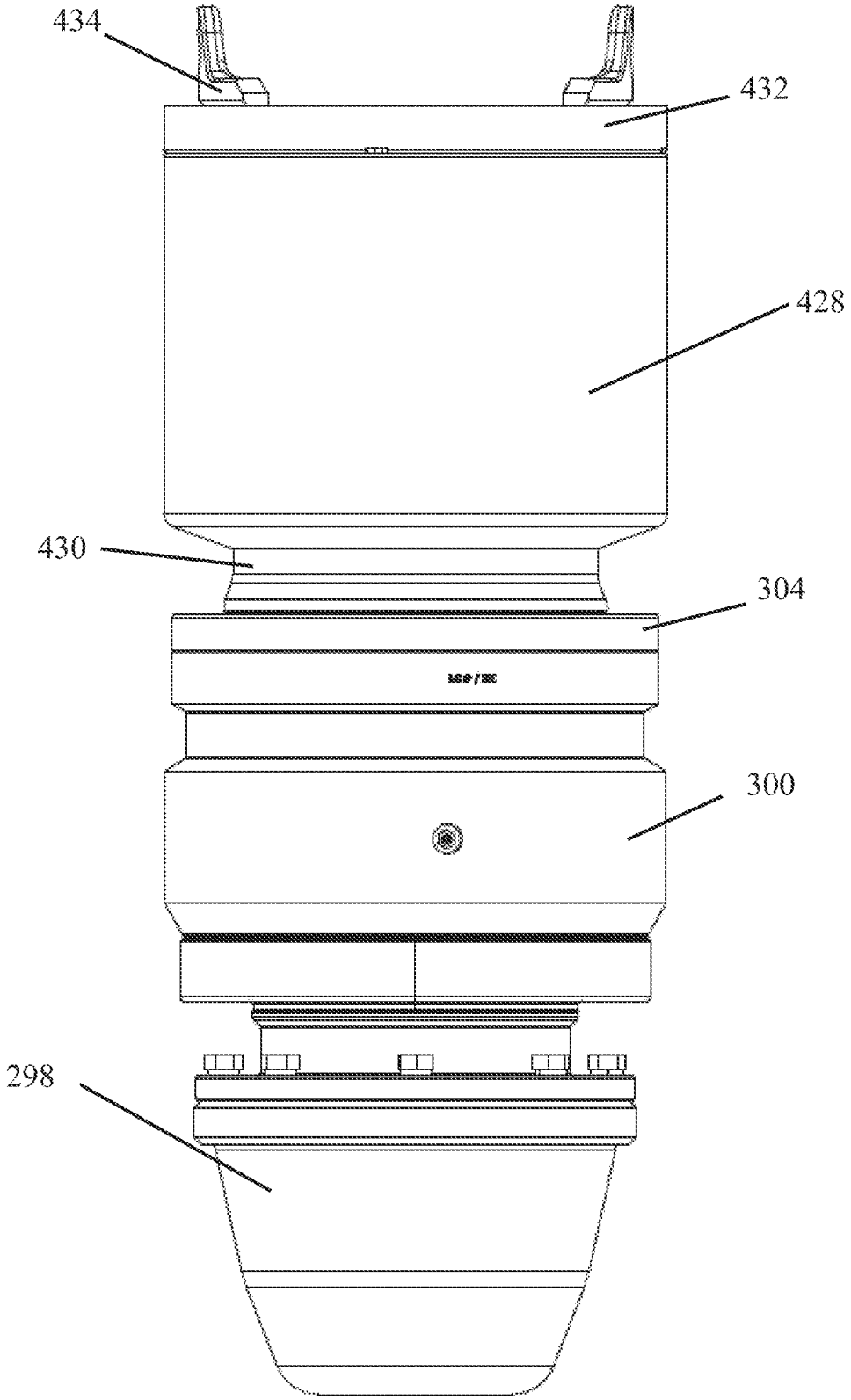
FIG. 35 is an environmental view of one embodiment of the present invention.
Figure 36:
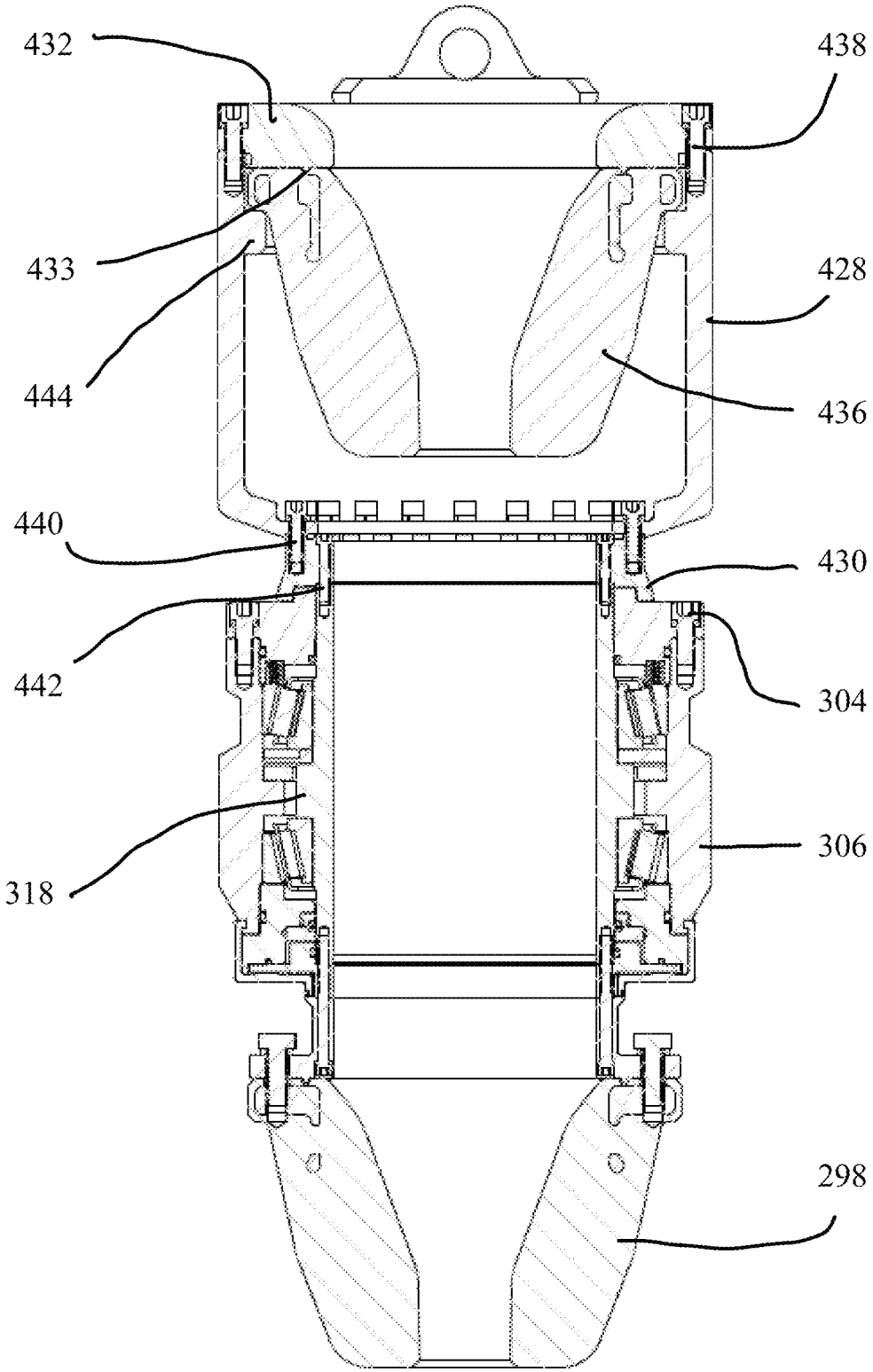
FIG. 36 is a sectional view thereof.

FIGS. 35 and 36 show another embodiment of the sealed lubricating head 300 implementing two sealing elements, such as rubbers 298, 436. The second rubber installs into top pot 428. Top drive guide 432 installs onto top pot 428 via fasteners 438. The top pot 428 installs onto inner barrel cap 430 via fasteners 440. Fasteners 442 secure the inner barrel cap 430 to the inner barrel 318.

Lift eyes 434 attach to the top drive guide 438. In one embodiment, lift eyes 434 bolt onto the top drive guide 438. The lift eyes 434 assist the user with lifting and installing the top drive guide 438 and top pot 428.

FIG. 36 shows the rubber installed within top pot 428. The top drive guide 432 provides a seal 433 that contacts the rubber 436 for sealing the connection. Flange 444 and top drive guide 432 secure the rubber 436 within the top pot 428.

Figure 38:
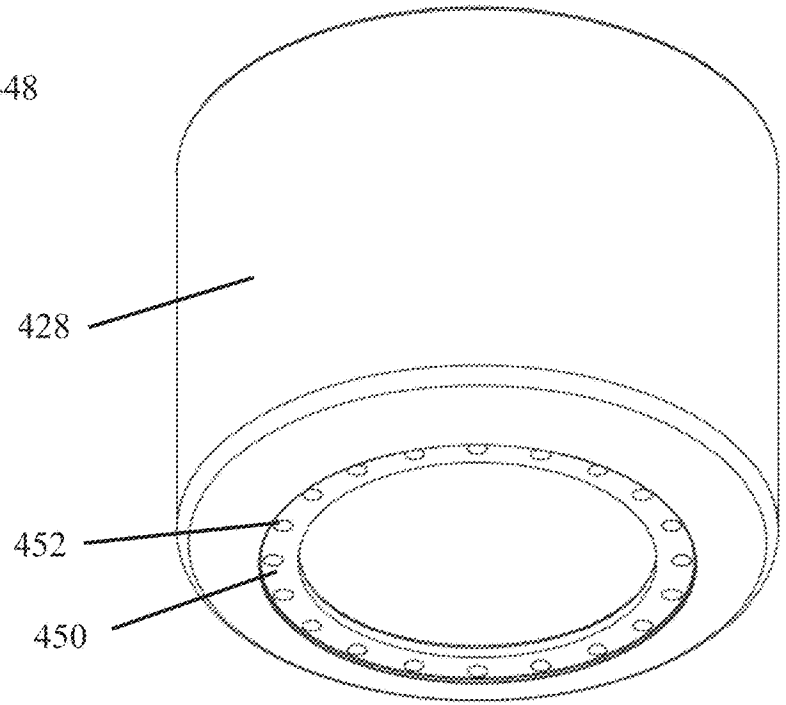
FIG. 38 is a perspective view thereof.
Figure 37:
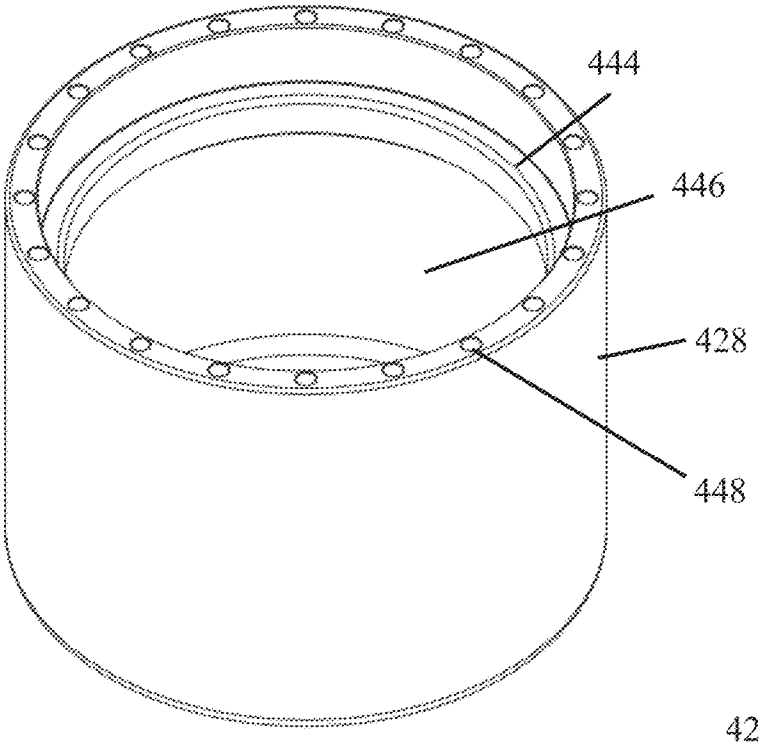
FIG. 37 is a perspective view of a component of one embodiment of the present invention.
Figure 39:
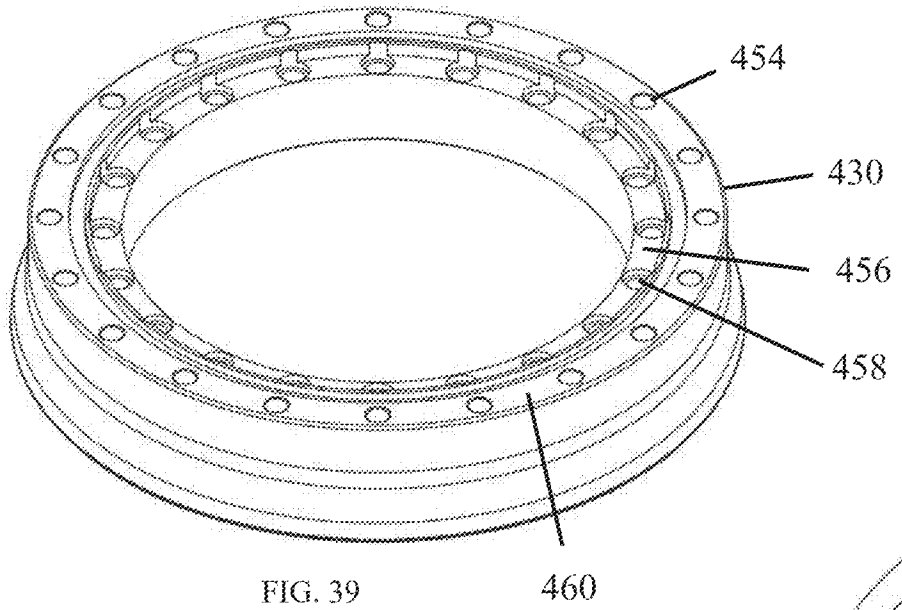
FIG. 39 is a perspective view of a component of one embodiment of the present invention.
Figure 40:
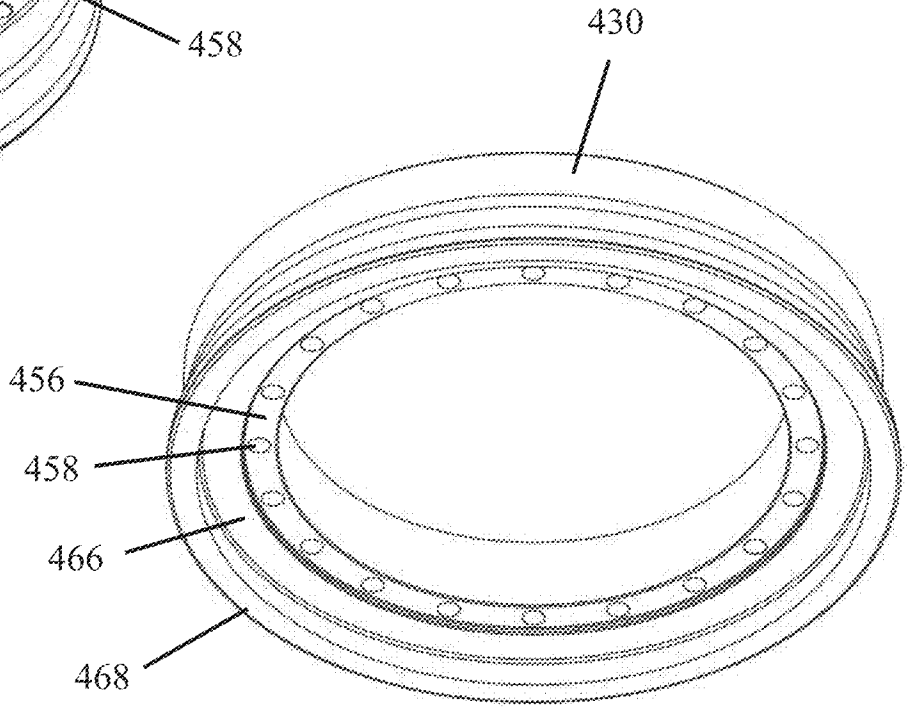
FIG. 40 is a perspective view thereof.

FIGS. 37-38 show the top pot 428. The top pot 428 forms a central aperture 446 for installing the rubber 436. Flange 444 limits downward movement of the rubber 436. The rubber 436 installs into the central aperture 446. Flange 444 contacts the rubber 436. Top drive 432 attaches to the top pot 428 via fasteners 438 installed into attachment apertures 448. The top drive guide 432 and flange 444 limit the vertical movement of the rubber 436 within the top pot 428 while enabling rotation of the rubber with the top pot 428.

FIG. 38 shows the lower attachment surface 450 of the top pot 428. Lower attachment surface 450 is located vertically above the bottom of the top pot 428 to allow partial insertion of the inner barrel cap 430 into the top pot 428 as shown in FIG. 36.

FIGS. 36-40 show the inner barrel cap 430 attached to the top pot 428 and inner barrel 318. The upper surface 460 of inner barrel cap 430 contacts the lower attachment surface 450 of the top pot 428. Fasteners 440 insert into attachment apertures 452, 454 to secure the top pot 428 to the inner barrel cap 430.

Barrel contact surface 456 is located radially inward and vertically downward from the upper surface 460. Fasteners 442 secure the inner barrel cap 430 to the inner barrel 318. Fasteners 442 pass through the inner barrel cap 430 into the inner barrel 318.

Attachment apertures 458 accept fasteners 442 to secure the inner barrel cap 430 to the inner barrel 318 as shown in FIG. 36. Barrel contact surface 456 is located radially outward from the bore. Attachment aperture 458 passes through the barrel contact surface 458. Barrel contact surface 458 contacts the inner barrel 318 when inner barrel cap 430 attaches to the rotating head assembly.

Carrier contact surface 466 is located radially outward from the barrel contact surface 456. Carrier contact surface 466 is located vertically below the barrel contact surface 456. The carrier contact surface 466 contacts the top seal carrier 304 when the inner barrel cap 430 attaches to the rotating head assembly.

Bottom surface 468 is located radially outward from the barrel contact surface 456 and carrier contact surface 466. Bottom surface 468 is located vertically below the barrel contact surface 456 and carrier contact surface 466. Bottom contact surface 468 also contacts the top seal carrier 304 when the inner barrel cap 430 attaches to the rotating head assembly. The bottom surface 468 is located radially outward from an upper portion of the top seal carrier 304 as shown in FIG. 36.

Figure 42:
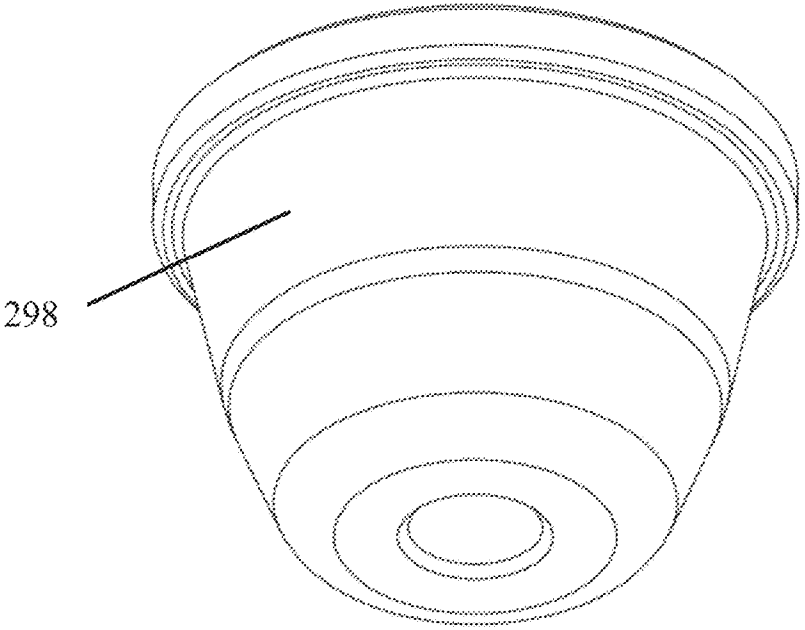
FIG. 42 is a perspective view thereof.
Figure 41:
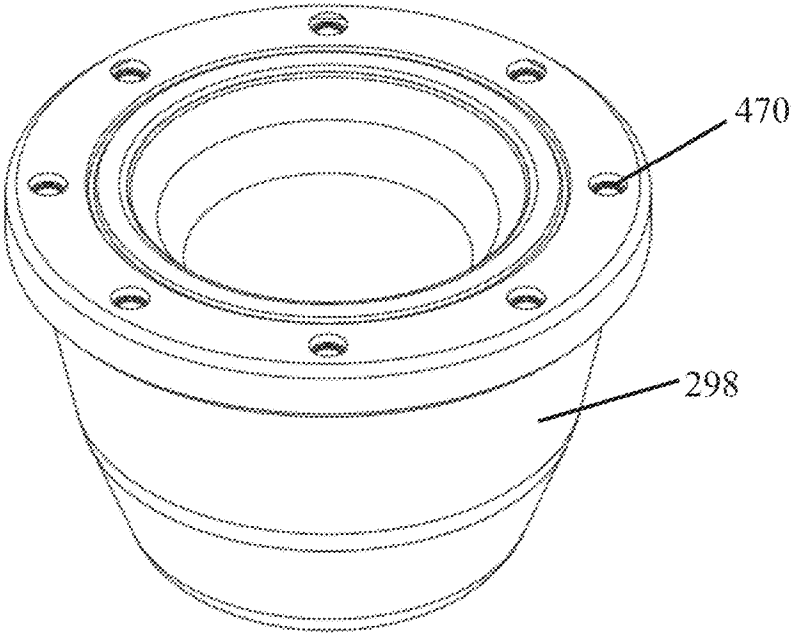
FIG. 41 is a perspective view of a component of one embodiment of the present invention.

FIGS. 41-42 show a sealing element, such as rubber 298. One rubber installs at the rubber adapter. Another seal, such as rubber 298, installs within the top pot. Attachment apertures 470 accept fasteners 296 to secure the rubber 298 to the rubber adapter 310. The rubber within the top pot is secured due to the friction caused by the top drive guide and the inner flange of the top pot. Such an attachment limits vertical movement of the rubber. The attachment also enables the rubber to rotate with the top pot.

Figure 43:
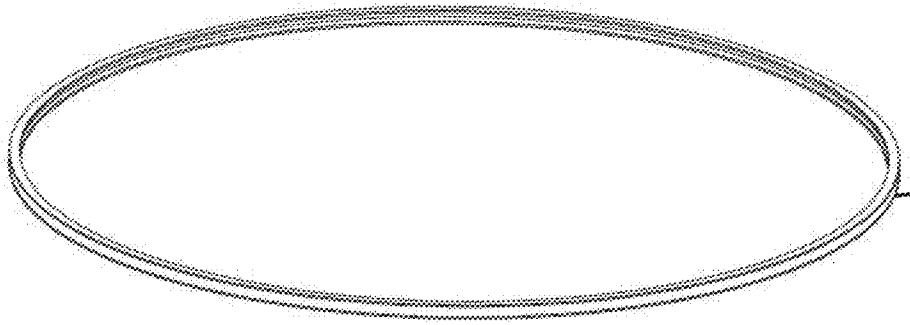
FIG. 43 is a perspective view of a component of one embodiment of the present invention.
Figure 44:
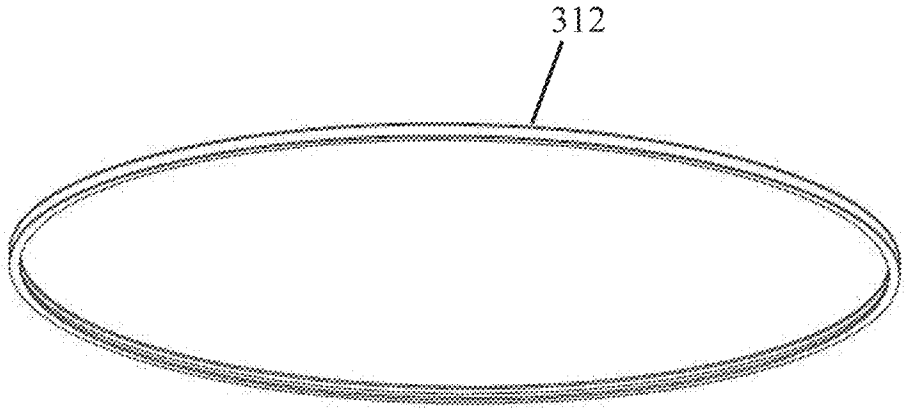
FIG. 44 is a perspective view thereof.

FIGS. 43 and 44 show the seal 312. Seal 312 is constructed from Teflon®, such as PTFE (polytetrafluoroethylene), to form the PTFE seal. The PTFE seal 312 reduces friction and heat buildup. Such reduction provides simpler maintenance and improved function of seal 312.

Figure 45:
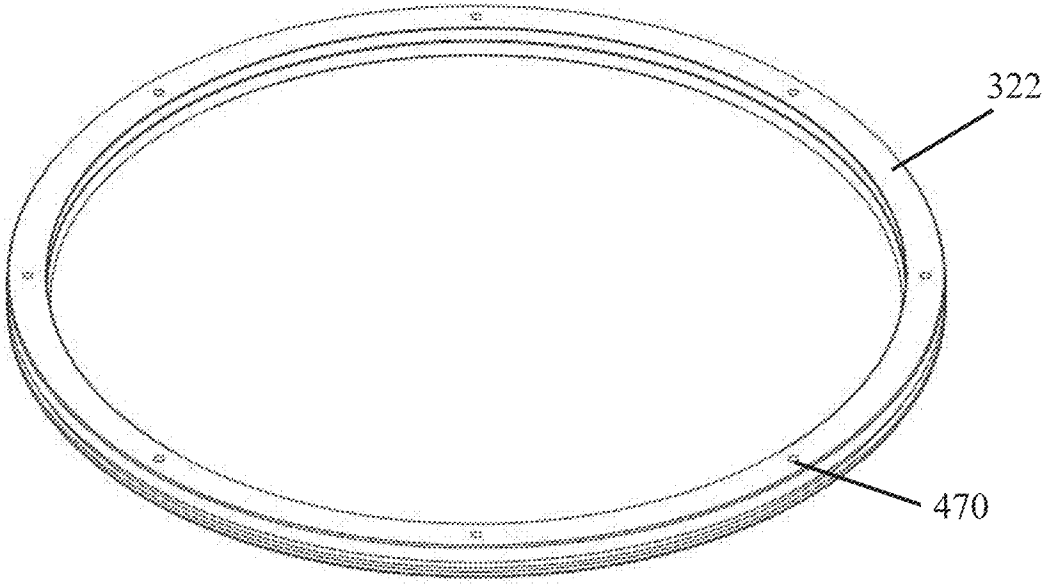
FIG. 45 is a perspective view of a component of one embodiment of the present invention.
Figure 46:
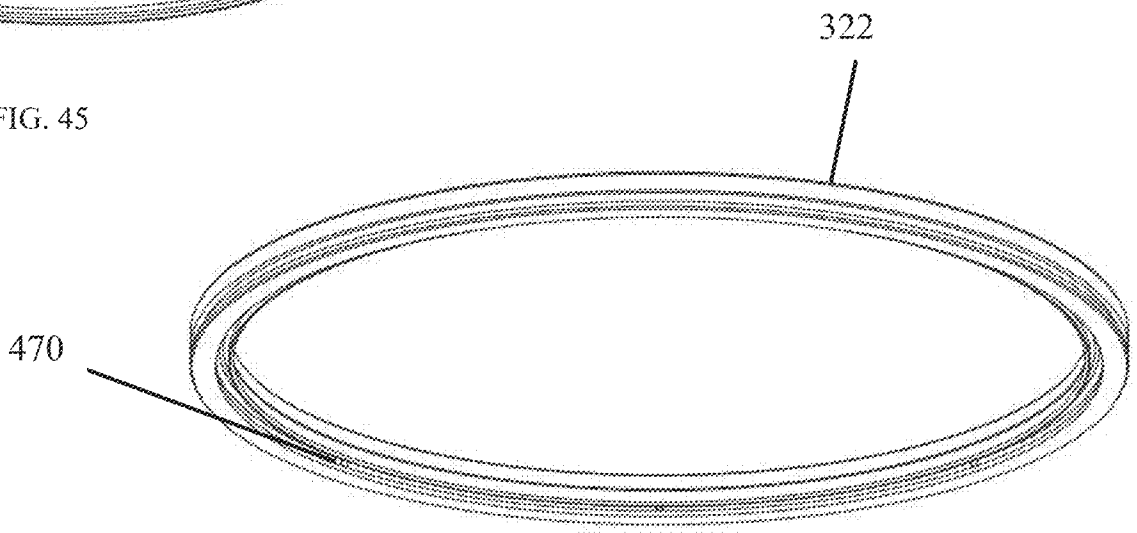
FIG. 46 is a perspective view thereof.

FIGS. 45-46 show seal 322. Seal 322 provides attachment apertures 470. Fasteners insert into the attachment apertures 470 to install the seal 322 onto the bottom seal carrier 324 at attachment apertures 411 as shown at FIGS. 19 and 32.

Figure 47:
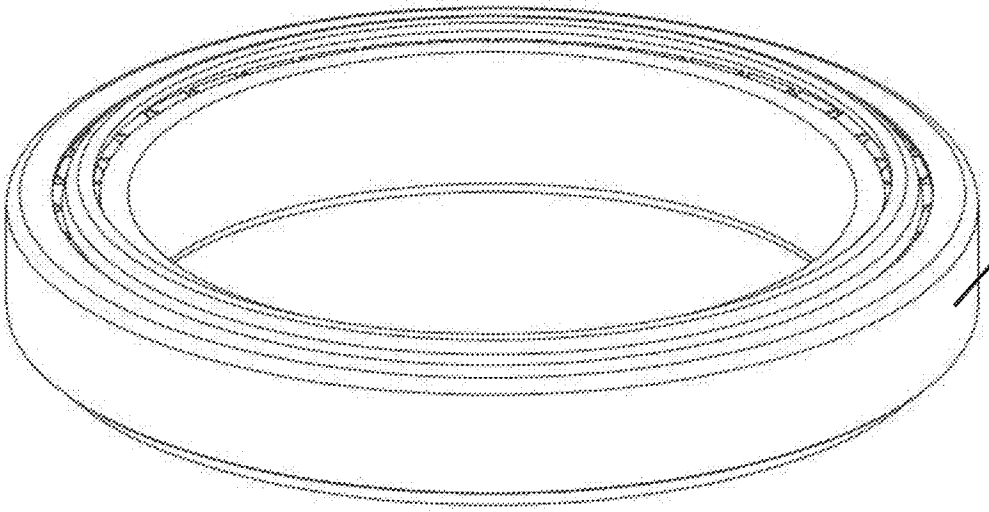
FIG. 47 is a perspective view of a component of one embodiment of the present invention.
Figure 48:
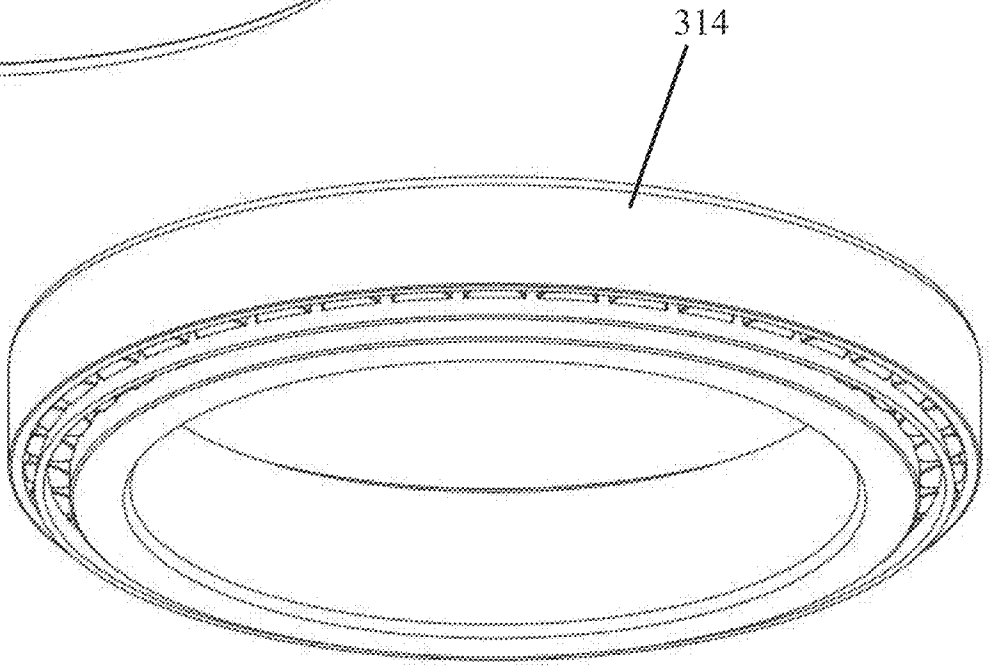
FIG. 48 is a perspective view thereof.

FIGS. 47 and 48 show bearing element 314, such as the bearings 314, 320. Bearings 314, 320 install between the inner barrel 318 and the outer barrel 306.

Referring to FIG. 19, the lubricating compartment 313 stores lubrication, such as grease or oil, to be applied to the bearings 314, 320 located between the outer barrel 306 and the inner barrel 318. The top seal 312 forms the top of the lubricating compartment 313 while the bottom seal 322 forms the bottom of the lubricating compartment 313. Inner barrel flange 316 supports the bearing 314 for rotating inner barrel 318 within outer barrel 306.

The top seal carrier 304 attaches to the outer barrel 306 for sealing the top portion of lubricating compartment 313. The top seal carrier 304 places the top seal 312 adjacent the top wear surface 429. The top seal carrier 304 may be machined to place the top seal 312 at different locations on the top wear surface 429. In another embodiment, the top seal carrier may not be machined to adjust the location of the top seal. The contact between the top seal 312 and the top wear surface 429 forms the seal located at the upper portion of lubricating compartment 323.

The bottom seal carrier 324 attaches to the outer barrel 306 for sealing the bottom portion of lubricating compartment 313. The bottom seal carrier 324 places the bottom seal 322 adjacent the bottom wear surface 433. The bottom seal carrier 324 may be machined to place the bottom seal 322 at different locations on the bottom wear surface 433. In another embodiment, the bottom seal carrier may not be machined to adjust the location of the bottom seal.

Bottom retainer 323 secures the bottom seal 322 adjacent the bottom seal carrier 324. The bottom seal retainer 323 attaches to the bottom seal carrier 324 via a fastener, such as a bolt, installed into aperture 420. The attachment of bottom seal carrier 322 with bottom seal retainer 323 creates a cavity for placement of the bottom seal 322. The bottom seal 322 is placed between the bottom seal retainer 323 and the bottom seal carrier 324 against the seal surface 433.

The contact between the bottom seal 322 and the bottom seal surface 433 seals the lower portion of lubricating compartment 313. In one embodiment, the bottom seal is secured to the bottom seal carrier by a fastener, including but not limited to a dowel pin. The attachment of the bottom seal to the bottom seal carrier and the outer barrel enables the bottom seal to remain fixed with the outer barrel.

In one embodiment, the top seal and bottom seal are secured to the outer barrel. The top seal and bottom seal in such an embodiment do not rotate with the inner barrel. Instead, the top seal and bottom seal remain fixed with the outer barrel.

The sealed lubricating head 300 provides lubrication to bearings 314, 320 in addition to top seal 312 and bottom seal 322. lubricant expands to approximately 30% above initial volume as it heats up. The internal pressure also increases as temperature increases. "Thickeners" in the lubricant release oil as the temperature rises.

In one embodiment, the lubricating compartment 313 is filled to ⅔ capacity with lubricant. The initial fill of lubricant covers the bearings 314, 320 located in the lubricating compartment 313. If the lubricating compartment 313 is completely filled with lubricant prior to use, as the head heats up under normal operating parameters, lubricant will be forced out of the seals which would not be permissible.

The lubricating compartment 313 is filled to ⅔ capacity with lubricant to increase bearing life and bearing lubrication. A coating of lubricant is also applied to the top seal 312 prior to operation as lubrication is required for each seal to function as designed. As the head 300 heats up under normal use, the lubricant expands to lube the top seal 312.

The larger bore 326 size of the lubricating head 300 allows rig operators to run larger size bits in the hole. Frequently, large drill bits are pulled up into the RCD while stripping the bits out of the well. These bits may then become lodged in the RCD bore. This causes down time on the rig and higher drilling cost to the driller. This also causes higher refurbishing costs to the manufacturer required by removal of the bit from the equipment. The nine inch bore of one embodiment of the present invention alleviates many of the problems associated with smaller bore equipment.

Each seal 312, 322 contacts a wear surface 429, 433. Each seal surface 429, 433 may be constructed from a tungsten sleeve attached to the inner barrel 318. As the seal surface 429, 433 wears, the seal cavity may be machined again to place the seal 312, 322 at a new location to wear a new area of the seal surface. Each seal contacts its own seal surface. Top seal 312 contacts top seal surface 429. Bottom seal 322 contacts bottom seal surface 433.

As the seal surface 429, 433 is depleted, the user may replace the seal surface by attaching a new seal surface on the inner barrel 318. The attachment of a new seal surface allows for a longer life of the inner barrel 318 thus reducing costs and waste.

In one embodiment, the top seal 322 is constructed from a bronze infused PTFE seal. The top seal 322 maintains proper greasing by absorbing lubricant from lubricant compartment 313. The absorption of lubricant by top seal 322 enables proper sealing of top seal 322 and provides sufficient lubricant to bearing 314.

Figure 49:
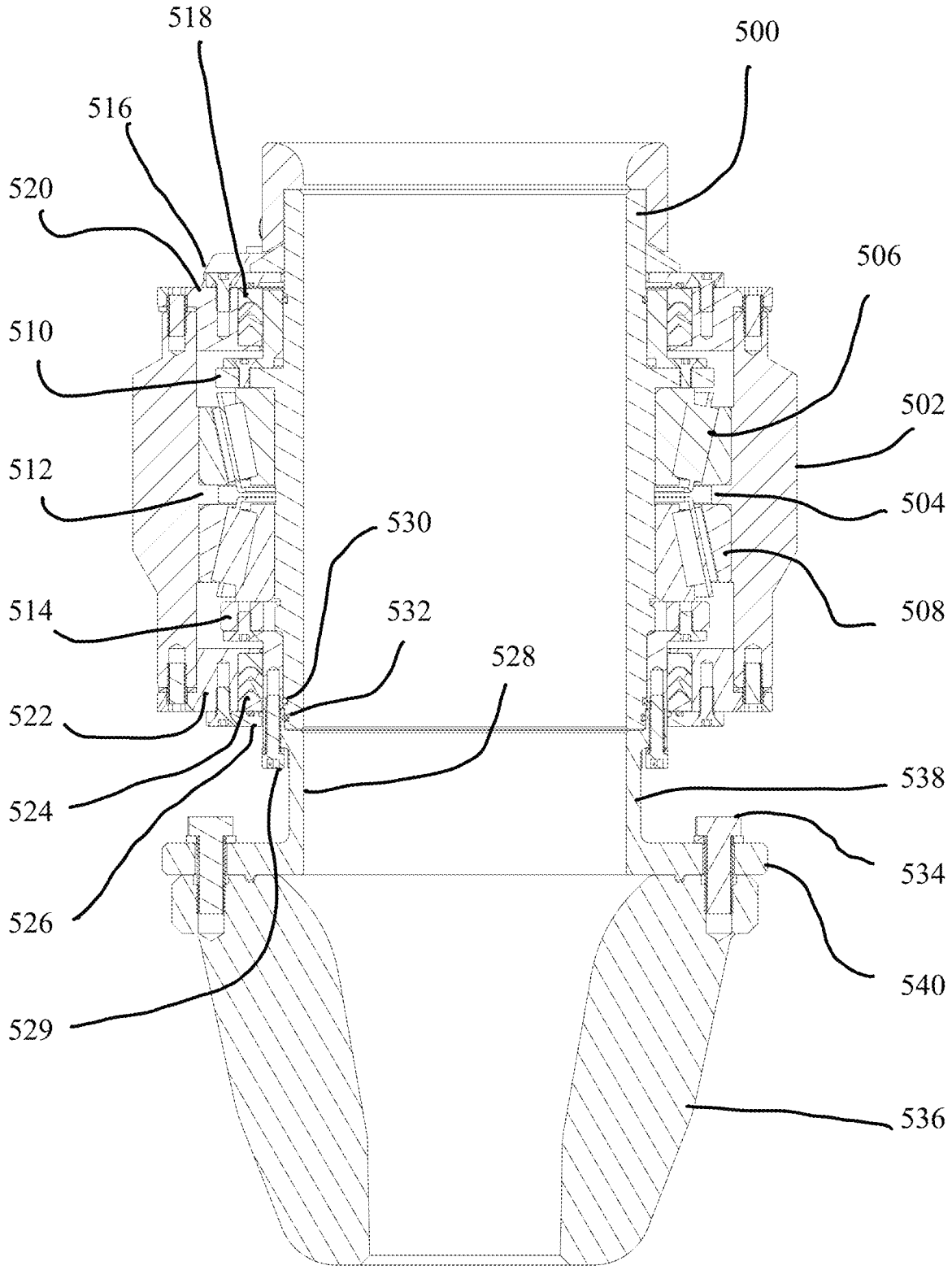
FIG. 49 is a sectional view of one embodiment of the present invention.

FIG. 49 shows a sectional view of a sealed lubricating head that provides lubricating compartment 504 for installation of upper bearings 506 and lower bearings 508. The upper bearings 506 and lower bearings 508 enable rotation of the inner barrel 500 in relation to the outer barrel 502.

The lubricating compartment 504 provides an upper support 510, middle support 512, and lower support 514 for seating the bearings 506, 508. The upper support 510 and lower support 514 extend radially outwards from the inner barrel 500 towards the outer barrel 502. The middle support 512 extends radially inward from the outer barrel 502 towards the inner barrel 500.

The upper support 510 seats an upper surface of the upper bearing 506. The middle support 512 seats a lower surface of the upper bearing 506 and an upper surface of the lower bearing 508. The lower support 514 seats the lower surface of the lower bearing 508.

The sealed lubricating head provides an upper plate 516 and lower plate 526 for seating seals 518, 524 carried by seal carriers 520, 522 secured by fasteners to the outer barrel 502. The plates 516, 526 vertically support the seals 518, 524. The seal carriers 520, 522 radially support the seals 518, 524 from radially outward of the seals 518, 524.

Rubber adapter 528 secures to the inner barrel 500 for rotation of the rubber 536 and the rubber adapter 528 with the inner barrel 500. Seals 530, 532 located radially outward from the inner barrel 500 seal against the rubber adapter 528. The rubber adapter 528 provides an attachment neck 538 that extends upward from the attachment shoulder 540. The attachment neck 538 includes an upper surface that accepts passage of fastener 529 vertically upward into the inner barrel 500 to secure the rubber adapter 528 to the inner barrel.

The attachment shoulder 540 accepts a fastener, such as a bolt, inserted vertically downward into the rubber 536 to secure the rubber 536 to the inner barrel 500. The attachment neck 538 provides sufficient vertical/longitudinal clearance from the attachment shoulder 540 for installation and removal of the fastener inserted vertically downward to secure the rubber 536 to the inner barrel 500.

The sealed lubricating head allows rotation of the inner barrel while the outer barrel remains stationary. A number of the components rotate with the inner barrel. Such components that rotate with the inner barrel include the top drive guide, the top pot, rubber adapter head, the rubber adapter, and the wear surfaces.

Other components remain stationary with the outer barrel. Such components that remain stationary with the outer barrel include the top seal carrier, the bearings, the seal retainers, and the lower seal retainer.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A sealing system for forming a seal between an inner barrel secured to a drilling rubber and an outer barrel to seal a first bearing and a second bearing, the system comprising:

a lubricating compartment formed between the inner barrel and the outer barrel;

a bottom seal located at a bottom of the lubricating compartment;

a top seal located at a top of the lubricating compartment, wherein the top seal and the bottom seal are configured to seal the lubricating compartment;

a central support extending radially inward from the outer barrel towards the inner barrel, wherein the central support is located longitudinally between the first bearing and the second bearing, wherein the central support is configured to contact both the first bearing and the second bearing;

wherein no inlets extend into the lubricating compartment to supply lubricant into the lubricating compartment;

a rubber adapter to which the rubber attaches, the rubber adapter secured to the inner barrel;

a seal extending downward from the rubber adapter, wherein the rubber adapter directly contacts the drilling rubber, the seal sealing against the rubber adapter and the drilling rubber;

wherein the rubber adapter receives a fastener inserted through the rubber adapter into the rubber to secure the rubber to the rubber adapter, wherein the fastener terminates prior to passing through the rubber;

an outer attachment aperture of the rubber adapter, wherein the fastener inserts vertically downward through the outer attachment aperture into the rubber to secure the rubber to the rubber adapter;

an inner attachment aperture of the rubber adapter located radially inward from the outer attachment aperture of the rubber adapter, wherein a fastener inserts vertically upward through the inner attachment aperture to secure the rubber adapter to the inner barrel.

2. A sealing system for forming a seal between an inner barrel secured to a drilling rubber and an outer barrel to seal a first bearing and a second bearing, the system comprising:

a lubricating compartment formed between the inner barrel and the outer barrel;

a bottom seal located at a bottom of the lubricating compartment;

a top seal located at a top of the lubricating compartment, wherein the top seal and the bottom seal are configured to seal the lubricating compartment;

a central support extending radially inward from the outer barrel towards the inner barrel, wherein the central support is located longitudinally between the first bearing and the second bearing, wherein the central support is configured to contact both the first bearing and the second bearing;

wherein no inlets extend into the lubricating compartment to supply lubricant into the lubricating compartment;

a lower support extending radially outward from the inner barrel towards the outer barrel to seat the first bearing;

an upper support extending radially outward from the inner barrel vertically above the first bearing;

wherein the upper support and the lower support are extensions of the inner barrel.

3. A sealing system for forming a seal between an inner barrel secured to a drilling rubber and an outer barrel to seal a first bearing and a second bearing, the system comprising:

a lubricating compartment formed between the inner barrel and the outer barrel;

a bottom seal located at a bottom of the lubricating compartment;

a top seal located at a top of the lubricating compartment, wherein the top seal and the bottom seal are configured to seal the lubricating compartment;

a central support extending radially inward from the outer barrel towards the inner barrel, wherein the central support is located longitudinally between the first bearing and the second bearing, wherein the central support is configured to contact both the first bearing and the second bearing;

wherein no inlets extend into the lubricating compartment to supply lubricant into the lubricating compartment;

a lower support extending radially outward from the inner barrel towards the outer barrel to seat the first bearing;

an upper support extending radially outward from the inner barrel vertically above the first bearing;

wherein the central support is located longitudinally between the upper support and the lower support;

wherein the central support is an extension of the outer barrel.

4. A sealing system for forming a seal between an inner barrel secured to a drilling rubber and an outer barrel to seal an upper bearing and a lower bearing, the system comprising:

a lubricating compartment formed between the inner barrel and the outer barrel in which the upper bearing and the lower bearing are located;

a lower support extending radially outward from the inner barrel, wherein the lower support is located vertically below the lower bearing;

an upper support extending radially outward from the inner barrel, wherein the upper support is located vertically above the upper bearing; and a central support extending radially inward from the outer barrel towards the inner barrel, wherein the central support is located longitudinally between the upper support and the lower support;

wherein no inlets extend into the lubricating compartment to supply lubricant into the lubricating compartment.

5. The system of claim 4, wherein no seal separates the upper bearing from the lower bearing to enable lubricant to flow to the upper bearing and the lower bearing within the lubricating compartment.

6. The system of claim 4, wherein the upper support is configured to seat the upper bearing and the lower support is configured to seat the lower bearing.

7. A sealing system for forming a seal between an inner barrel secured to a drilling rubber and an outer barrel to seal a first bearing and a second bearing, the system comprising:

a lubricating compartment formed between the inner barrel and the outer barrel;

a top plate that forms a top of the lubricating compartment;

a bottom plate that forms a bottom of the lubricating compartment;

a bottom seal located between the top plate and the bottom plate;

a top seal located between the top plate and the bottom plate, wherein the top seal and the bottom seal are configured to seal the lubricating compartment;

wherein no inlets extend into the lubricating compartment to supply lubricant into the lubricating compartment;

a rubber adapter to which the rubber attaches, the rubber adapter secured to the inner barrel;

a seal extending downward from the rubber adapter, wherein the rubber adapter directly contacts the drilling rubber, the seal sealing against the rubber adapter and the drilling rubber;

wherein the rubber adapter receives a fastener inserted through the rubber adapter into the rubber to secure the rubber to the rubber adapter, wherein the fastener terminates prior to passing through the rubber;

an outer attachment aperture of the rubber adapter, wherein the fastener inserts vertically downward through the outer attachment aperture into the rubber to secure the rubber to the rubber adapter;

an inner attachment aperture of the rubber adapter located radially inward from the outer attachment aperture of the rubber adapter, wherein a fastener inserts vertically upward through the inner attachment aperture to secure the rubber adapter to the inner barrel.

8. A sealing system for forming a seal between an inner barrel secured to a drilling rubber and an outer barrel to seal a first bearing, the system comprising:

a lubricating compartment formed between the inner barrel and the outer barrel;

a top plate that forms a top of the lubricating compartment;

a bottom plate that forms a bottom of the lubricating compartment;

a bottom seal located between the top plate and the bottom plate;

a top seal located between the top plate and the bottom plate, wherein the top seal and the bottom seal are configured to seal the lubricating compartment;

wherein no inlets extend into the lubricating compartment to supply lubricant into the lubricating compartment;

a lower support extending radially outward from the inner barrel towards the outer barrel to seat the first bearing;

an upper support extending radially outward from the inner barrel vertically above the first bearing;

wherein the upper support and the lower support are extensions of the inner barrel.

9. A sealing system for forming a seal between an inner barrel secured to a drilling rubber and an outer barrel to seal a first bearing, the system comprising:

a lubricating compartment formed between the inner barrel and the outer barrel;

a top plate that forms a top of the lubricating compartment;

a bottom plate that forms a bottom of the lubricating compartment;

a bottom seal located between the top plate and the bottom plate;

a top seal located between the top plate and the bottom plate, wherein the top seal and the bottom seal are configured to seal the lubricating compartment;

wherein no inlets extend into the lubricating compartment to supply lubricant into the lubricating compartment;

a lower support extending radially outward from the inner barrel towards the outer barrel to seat the first bearing;

an upper support extending radially outward from the inner barrel vertically above the first bearing;

a central support extending radially inward from the outer barrel, wherein the central support is located longitudinally between the upper support and the lower support;

wherein the central support is an extension of the outer barrel.

10. A sealing system for forming a seal between an inner barrel secured to a drilling rubber and an outer barrel to seal an upper bearing and a lower bearing, the system comprising:

a lubricating compartment formed between the inner barrel and the outer barrel in which the upper bearing and the lower bearing are located;

a lower support extending radially outward from the inner barrel, wherein the lower support is located vertically below the lower bearing;

an upper support extending radially outward from the inner barrel, wherein the upper support is located vertically above the upper bearing;

wherein the upper support and the lower support form unitary components of the inner barrel;

a central support extending radially inward from the outer barrel towards the inner barrel, wherein the central support is located longitudinally between the upper support and the lower support.

11. A sealing system for forming a seal between an inner barrel secured to a drilling rubber and an outer barrel to seal an upper bearing and a lower bearing, the system comprising:

a lubricating compartment formed between the inner barrel and the outer barrel in which the upper bearing and the lower bearing are located;

a lower support extending radially outward from the inner barrel, wherein the lower support is located vertically below the lower bearing;

an upper support extending radially outward from the inner barrel, wherein the upper support is located vertically above the upper bearing;

wherein the upper support and the lower support form unitary components of the inner barrel;

wherein the upper support is configured to seat the upper bearing and the lower support is configured to seat the lower bearing.

* * * * *